US008229322B2

(12) United States Patent
Sato et al.

(10) Patent No.: US 8,229,322 B2
(45) Date of Patent: Jul. 24, 2012

(54) IMAGE FORMING APPARATUS AND APPARATUS EXTERIOR UNIT

(75) Inventors: Koichi Sato, Ebina (JP); Masaaki Tokunaga, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 143 days.

(21) Appl. No.: 12/782,282

(22) Filed: May 18, 2010

(65) Prior Publication Data

US 2011/0110685 A1 May 12, 2011

(30) Foreign Application Priority Data

Nov. 10, 2009 (JP) ..... 2009-257301

(51) Int. Cl.
*G03G 15/00* (2006.01)
*G03G 15/16* (2006.01)

(52) U.S. Cl. ..... 399/121

(58) Field of Classification Search ..... 399/121, 399/124, 125
See application file for complete search history.

(56) References Cited

U.S. PATENT DOCUMENTS

2007/0212108 A1* 9/2007 Hozono et al. ..... 399/121
2009/0022514 A1* 1/2009 Fujiwara et al. ..... 399/121
2010/0003051 A1* 1/2010 Sekina et al. ..... 399/121
2010/0178077 A1* 7/2010 Matsushima et al. ..... 399/121

FOREIGN PATENT DOCUMENTS

JP 2000-330352 A 11/2000

* cited by examiner

*Primary Examiner* — Sophia S Chen
(74) *Attorney, Agent, or Firm* — Sughrue Mion, PLLC

(57) ABSTRACT

An image forming apparatus includes: an image carrier carrying a toner image; a transfer unit including: a transfer body transferring the toner image onto a recording medium; and a positioning portion positioning the transfer body with respect to the image carrier; a guide portion guiding the recording medium to a position where the toner image is to be transferred onto the recording medium; and an opening and closing unit supporting the transfer unit and the guide portion and provided to be openable and closable by rotating with respect to a main body of the apparatus about a predetermined rotation center, the opening and closing unit forming different angles with the main body between when a force required to position the transfer unit with respect to the main body reaches a maximum value, and when a force required to position the guide portion with respect to the main body reaches a maximum value.

10 Claims, 18 Drawing Sheets

IMAGE FORMING APPARATUS AND APPARATUS EXTERIOR UNIT

CROSS REFERENCE TO RELATED APPLICATIONS

This application is based on and claims priority under 35 USC §119 from Japanese Patent Application No. 2009-257301 filed Nov. 10, 2009.

BACKGROUND

1. Technical Field

The present invention relates to an image forming apparatus and an apparatus exterior unit.

2. Related Art

Nowadays, many image forming apparatuses are proposed, which are configured such that an opening and closing member (a cover) supporting a transfer roller is closed, and thereby the transfer roller is pressed against an image carrier on a surface of which a toner image is carried.

SUMMARY

According to an aspect of the present invention, there is provided an image forming apparatus including: an image carrier that carries a toner image; a transfer unit that includes a transfer body that transfers the toner image carried by the image carrier onto a recording medium, and a positioning portion that positions the transfer body with respect to the image carrier by contact with a counterpart positioning portion provided to a main body of the image forming apparatus; a guide portion that guides the recording medium to a position where the transfer body is to transfer the toner image carried by the image carrier onto the recording medium; and an opening and closing unit that supports both of the transfer unit and the guide portion and that is provided to be openable and closable by rotating with respect to the apparatus main body about a predetermined rotation center, the opening and closing unit forming different angles with respect to the apparatus main body between when a force required to position the transfer unit with respect to the apparatus main body reaches a maximum value, and when a force required to position the guide portion with respect to the apparatus main body reaches a maximum value.

BRIEF DESCRIPTION OF THE DRAWINGS

Exemplary embodiment of the present invention will be described in detail based on the following figures, wherein.

DETAILED DESCRIPTION

Hereinafter, an exemplary embodiment of the present invention is described in detail with reference to the accompanying drawings.

Figure 1:
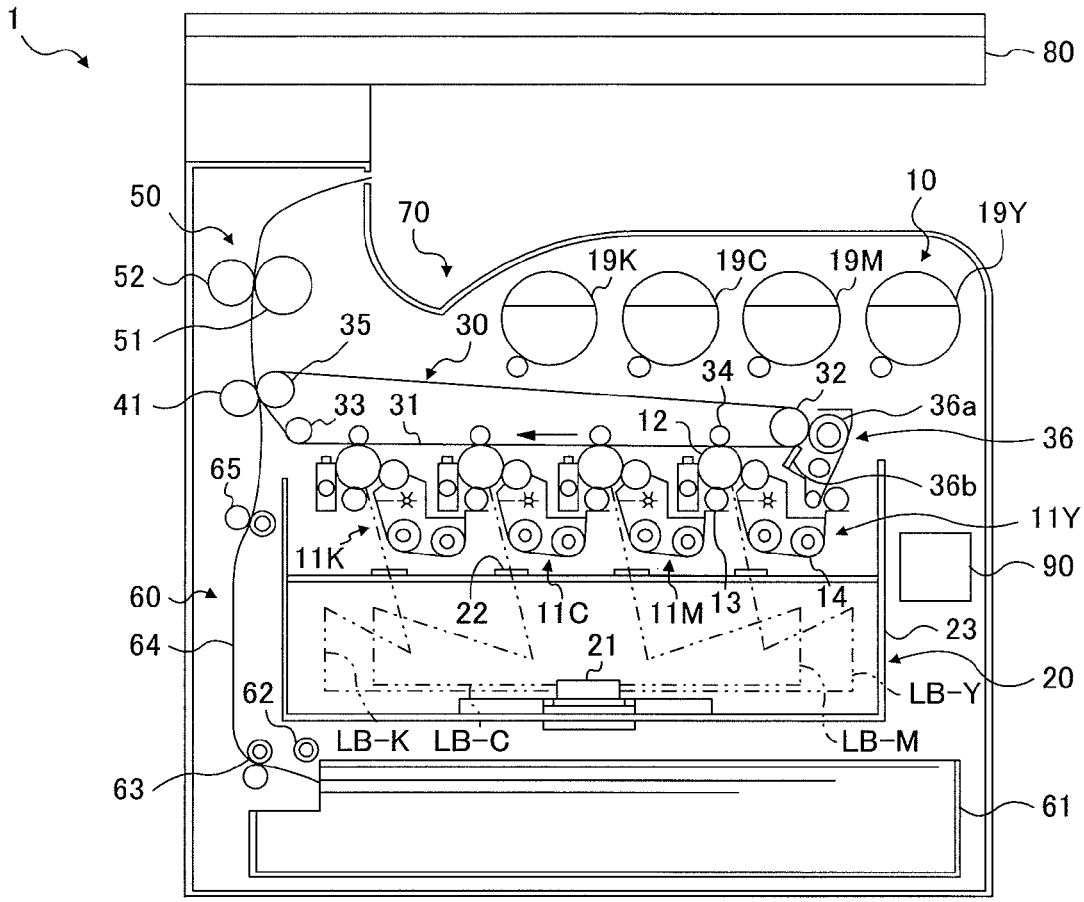
FIG. 1 is a diagram showing a schematic configuration of an image forming apparatus to which an exemplary embodiment of the present invention is applied.

FIG. 1 is a diagram showing a schematic configuration of an image forming apparatus 1 to which the exemplary embodiment of the present invention is applied.

The image forming apparatus 1 includes: an image forming unit 10 that forms an image on a recording medium (hereinafter, representatively, referred to as a "sheet" in some cases); a sheet supplying unit 60 that supplies the sheet to the image forming unit 10; and a sheet stacking unit 70 on which the sheets each including an image formed by the image forming unit 10 are stacked. The image forming apparatus 1 also includes: an image reader 80 that reads out an image of an original; and a controller 90 that controls an operation of each component.

The image forming unit 10 includes four image formation units 11Y, 11M, 11C and 11K of yellow (Y), magenta (M), cyan (C) and black (K) that are arranged in parallel at certain intervals. Each of the image formation units 11 includes: a photoconductive drum 12; a charging device 13 that uniformly charges the surface of the photoconductive drum 12; and a developing device 14 that develops an electrostatic latent image with predetermined color component toners and thus visualizes the image, the electrostatic latent image being formed by a later-described optical system unit 20 using laser irradiation. In addition, the image forming unit 10 is provided with toner cartridges 19Y, 19M, 19C and 19K that supply the color toners to the developing devices 14 of the image formation units 11Y, 11M, 11C and 11K, respectively. Then, the optical system unit 20 that emits a laser beam to the photoconductive drums 12 of the image formation units 11Y, 11M, 11C and 11K is arranged below the image formation units 11Y, 11M, 11C and 11K.

In addition, the image forming unit 10 includes: an intermediate transfer unit 30 that transfers the color toner images formed on the photoconductive drums 12 of the respective image formation units 11Y, 11M, 11C and 11K, onto an intermediate transfer belt 31 in a multi-layered manner; a secondary transfer unit 40 (refer to FIG. 4) as an example of a transfer unit that transfers, onto the sheet, the toner images formed while being superimposed one on top of another on the intermediate transfer unit 30; and a fixing device 50 that fixes the formed toner images onto the sheet by applying heat and pressure thereto.

The optical system unit 20 includes a polygon mirror 21, glass-made windows 22, and a rectangular parallelepiped frame 23 in addition to not-shown semiconductor lasers and a modulator. The polygon mirror 21 deflects and scans laser beams (LB-Y, LB-M, LB-C and LB-K) emitted from the semiconductor lasers. The windows 22 allow the laser beams to pass therethrough. The frame 23 seals the component members.

The intermediate transfer unit 30 includes: the intermediate transfer belt 31 as an example of an image carrier that is an intermediate transfer body; a drive roller 32 that drives the intermediate transfer belt 31; and a tension roller 33 that provides a constant tension to the intermediate transfer belt 31. Moreover, the intermediate transfer unit 30 includes: multiple primary transfer rollers 34 (four rollers in the present exemplary embodiment) that face the respective photoconductive drums 12 with the intermediate transfer belt 31 interposed therebetween and transfer the toner images formed on the photoconductive drums 12 onto the intermediate transfer belt 31; and a backup roller 35 that is provided facing a later-described secondary transfer roller 41 with the intermediate transfer belt 31 interposed therebetween.

The intermediate transfer belt 31 is wound around the multiple roll members including the drive roller 32, the tension roller 33, the multiple primary transfer rollers 34 and the backup roller 35 with the constant tension applied thereto so that its length in a direction in which the multiple primary transfer rollers 34 are arranged may be longer than its length in the direction orthogonal to a plane including the rotation axes of the multiple primary transfer rollers 34. The intermediate transfer belt 31 is circularly driven by the drive roller 32 at a predetermined velocity in the direction indicated by an arrow, the drive roller 32 rotationally driven by a drive motor (not shown). As the intermediate transfer belt 31, one that is formed by rubber or resin is used, for example.

Moreover, the intermediate transfer unit 30 includes a cleaning device 36 that removes a residual toner and the like existing on the intermediate transfer belt 31. The cleaning device 36 includes a cleaning brush 36*a* and a cleaning blade 36*b*, and removes the residual toner, paper debris and the like from the surface of the intermediate transfer belt 31 after a transfer process of toner images is ended.

As described above, the intermediate transfer unit 30 has a thin and long shape in which the intermediate transfer belt 31 is wound around the drive roller 32, the tension roller 33 and the like so as to have a thin and long shape in the arrangement direction of the multiple primary transfer rollers 34. In addition, in the intermediate transfer unit 30, the backup roller 35 is arranged at one end in the longitudinal direction of the intermediate transfer belt 31 which is wound around the rollers to have the thin and long shape, and the cleaning device 36 is arranged at the other end thereof in the longitudinal direction.

Then, a front cover (not shown) is arranged at the front side of the intermediate transfer unit 30. The front cover covers the part located at the front side of the intermediate transfer unit 30 while fixing the intermediate transfer unit 30 to a main body frame 200 (refer to FIG. 3) that forms an apparatus main body of the image forming apparatus 1 in the present exemplary embodiment.

The secondary transfer unit 40 has the secondary transfer roller 41 as an example of a transfer body that forms a secondary transfer region between the secondary transfer roller 41 and the intermediate transfer belt 31 by pressing the backup roller 35 with the intermediate transfer belt 31 interposed therebetween and secondary-transfers toner images onto a sheet in the secondary transfer region. In order to transfer the toner images formed on the intermediate transfer belt 31 onto a sheet, the secondary transfer roller 41 provides the sheet with an electric charge having a polarity opposite to the toner charge polarity and thereby transfers the toner images on the intermediate transfer belt 31 onto the sheet with an electrostatic force. For this reason, a predetermined transfer electric field is to be generated between the secondary transfer roller 41 and the backup roller 35. The secondary transfer unit 40 is supported at a side cover 150 as an example of an opening and closing unit that is provided at the left side surface of the image forming apparatus 1 as viewed in FIG. 1. The configuration of the secondary transfer unit 40 is described later in detail.

The fixing device 50 fixes the images (toner images) secondary-transferred on the sheet by the intermediate transfer unit 30 to the sheet by a heat-fixing roller 51 and a pressure roller 52 using heat and pressure.

The sheet supplying unit 60 includes: a sheet housing unit 61 that houses sheets on which images are to be recorded; a nudger roller 62 that takes sheets from the sheet housing unit 61 and then supplies the sheets to a transport path 64; and a feed roller 63 that separates, one by one, the sheets supplied from the nudger roller 62 and then transports the sheets. In addition, the sheet supplying unit 60 includes: the transport path 64 that transports, towards the secondary transfer region, the sheets separated one by one by the feed roller 63; and registration rollers 65 that transport the sheet transported via the transport path 64 toward the secondary transfer region according to the secondary transfer timing.

The image forming apparatus 1 configured in the above-described manner operates as follows.

An image of an original that is read out by the image reader 80, or image data received from a not-shown personal computer or the like is subjected to predetermined image processing. The image data subjected to the image processing is then converted into coloring material continuous tone data of four colors of yellow (Y), magenta (M), cyan (C) and black (K) and then outputted to the optical system unit 20.

The optical system unit 20 outputs the laser beams emitted from the semiconductor lasers (not-shown) to the polygon mirror 21 via an f-θ lens (not shown) in accordance with the inputted coloring material continuous tone data. In the polygon mirror 21, the incident laser beams are modulated in accordance with the continuous tone data of the respective colors, and then deflected and scanned. The polygon mirror 21 then directs the laser beams to the photoconductive drums 12 of the image formation units 11Y, 11M, 11C and 11K via a not-shown imaging lens and not-shown multiple mirrors.

In the photoconductive drums 12 of the image formation units 11Y, 11M, 11C and 11K, their surfaces charged by the charging devices 13 are scanned and exposed, and thereby, electrostatic latent images are formed. The formed electrostatic latent images are developed as toner images of the respective colors of yellow (Y), magenta (M), cyan (C) and black (K) in the image formation units 11Y, 11M, 11C and 11K, respectively. The toner images formed on the photoconductive drums 12 of the image formation units 11Y, 11M, 11C and 11K are transferred in a multi-layered manner onto the intermediate transfer belt 31 that is an intermediate transfer body.

Meanwhile, in the sheet supplying unit 60, the nudger roller 62 rotates according to the timing of image formation to take the sheets housed in the sheet housing unit 61. Then, after the sheets are separated one by one by the feed roller 63, the sheet is transported to the registration rollers 65 via the transport path 64, and is once stopped there. Thereafter, the registration rollers 65 rotate according to the moving timing of the intermediate transfer belt 31 on which the toner images are formed. Then, the sheet is transported to the secondary transfer region formed by the backup roller 35 and the secondary transfer roller 41. The toner images obtained by forming the toner images of the four colors in a multi-layered manner are sequentially transferred onto the sheet in the slow scan direction by use of a pressure bonding force and a predetermined electric field, the sheet being transported upward in the secondary transfer region. Then, the sheet on which the color toner images are transferred is outputted after undergoing the fixing process performed by the fixing device 50 using heat and pressure. The sheet is then stacked in the sheet stacking unit 70.

Next, the intermediate transfer unit 30 is described in more detail.

Figure 2:
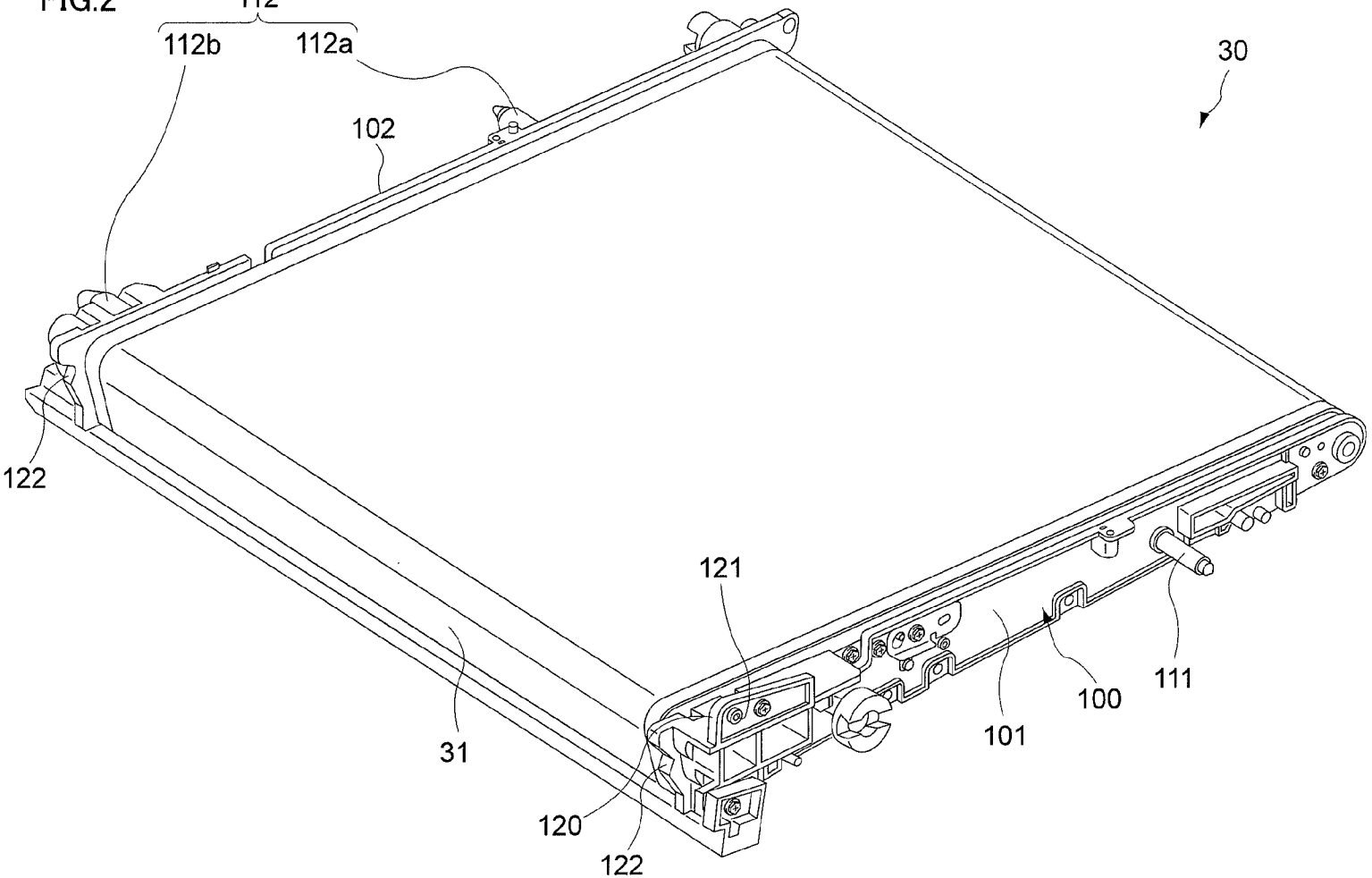
FIG. 2 is a perspective view of an intermediate transfer unit.

FIG. 2 is a perspective view of the intermediate transfer unit 30.

The intermediate transfer unit 30 includes the drive roller 32, the tension roller 33, the primary transfer rollers 34 and the backup roller 35 as described above. The intermediate transfer unit 30 further includes a support member 100 that supports the aforementioned rollers at their both sides in the rotation axis direction of the rollers (hereinafter, simply referred to as a "rotation axis direction" in some cases). The support member 100 has a front-side support member 101 provided at the front side of the intermediate transfer unit 30, and a backside support member 102 provided at the backside thereof as viewed in FIG. 1. The support member 100 rotatably supports the drive roller 32, the tension roller 33, the multiple primary transfer rollers 34 and the backup roller 35 by the front-side support member 101 and the backside support member 102. Then, the intermediate transfer belt 31 is wound around the drive roller 32, the tension roller 33, the primary transfer rollers 34 and the backup roller 35. The intermediate transfer belt 31 is circularly driven by the drive roller 32.

As described above, the intermediate transfer unit 30 is a component obtained by forming the intermediate transfer belt 31, the drive roller 32, the tension roller 33, the primary transfer rollers 34, the backup roller 35, the cleaning device 36, the support member 100 and the like into a unit. The intermediate transfer unit 30 is attached as the unit to the main body frame 200 of the image forming apparatus 1.

As shown in FIG. 2, multiple pins extending in the rotation axis direction are provided to the intermediate transfer unit 30. Specifically, the intermediate transfer unit 30 has one front-side pin 111 provided at the front-side support member 101 so as to protrude toward the front-side, and two backside pins 112 provided at the backside support member 102 so as to protrude toward the backside as viewed in FIG. 1. Each of the front-side pin 111 and the backside pins 112 is a stepped columnar member.

The front-side pin 111 is provided at a position between the primary transfer roller 34 facing the photoconductive drum 12 of the image formation unit 11Y and the primary transfer roller 34 facing the photoconductive drum 12 of the image formation unit 11M in the horizontal direction as viewed in FIG. 1, and at an inner side position of the intermediate transfer belt 31 in the vertical direction.

The two backside pins 112 are configured of a right backside pin 112*a* provided on the right side and a left backside pin 112*b* provided on the left side as viewed in FIG. 1. The right backside pin 112*a* is provided on a side of the intermediate transfer unit 30 opposite to the front-side pin 111 with the intermediate transfer belt 31 interposed therebetween. The left backside pin 112*b* is provided at a position between the backup roller 35 and the tension roller 33 in the horizontal direction as viewed in FIG. 1 and at an inner side position of the intermediate transfer belt 31 and at the same height as that of the backup roller 35 in the vertical direction.

In addition, brackets 120 in which holes 121 are formed are fixed to the front-side support member 101 at its left-side end portions in the horizontal direction as viewed in FIG. 1. Each bracket 120 protrudes upward from the top surface of the intermediate transfer belt 31 in the vertical direction as viewed in FIG. 1, and the hole 121 is formed in the protruding portion thereof. Each hole 121 is formed at the same position as that of the backup roller 35 in the horizontal direction as viewed in FIG. 1. In addition, a V-shaped positioning groove 122 as an example of a counterpart positioning portion is formed in each bracket 120, the counterpart positioning portion being used for determining the position of the secondary transfer roller 41 with respect to the backup roller 35 so that a distance between the rotation axis center of the backup roller 35 and the rotation axis center of the secondary transfer roller 41 may be a predetermined distance. As shown in FIG. 2, the positioning grooves 122 are formed at the both end portions of the intermediate transfer unit 30 in the rotation axis direction.

Figure 3:
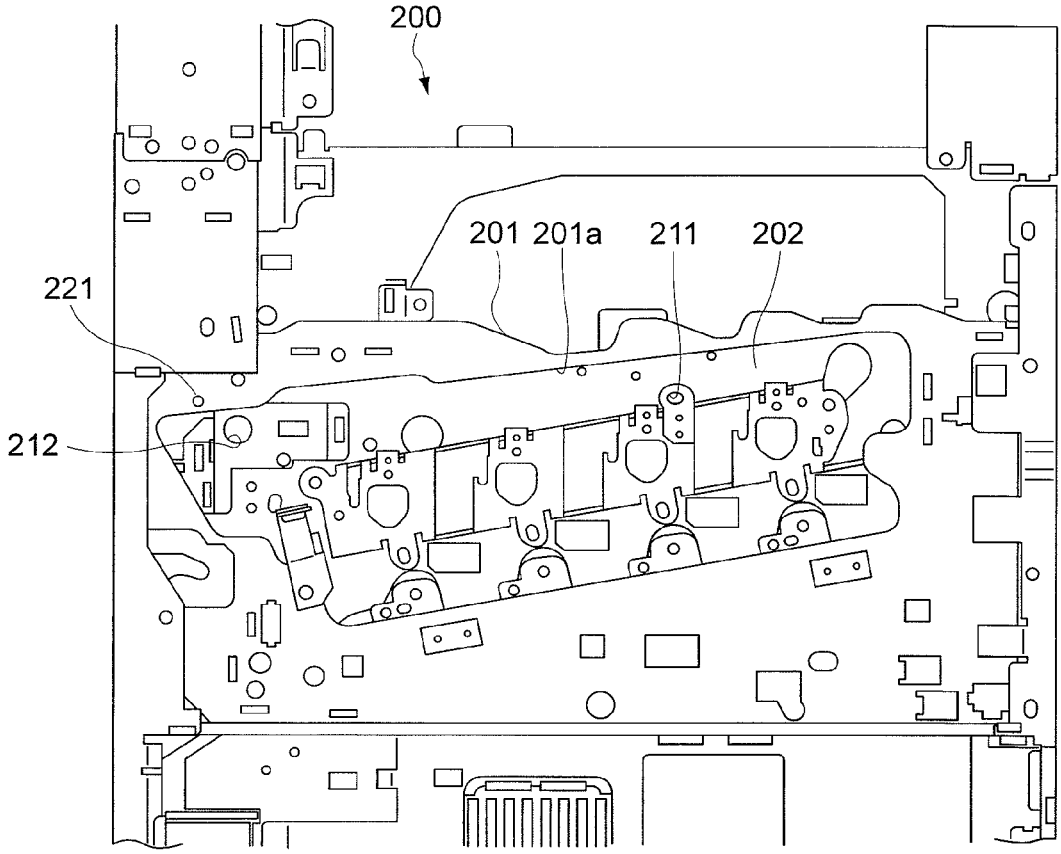
FIG. 3 is a diagram showing an external appearance of a main body frame.

FIG. 3 is a diagram showing an external appearance of the main body frame 200. FIG. 3 is a diagram showing the main body frame 200 as viewed in the same direction as FIG. 1.

The main body frame 200 has a front-side frame 201 in which an insertion hole 201*a* is formed, and a backside frame 202 provided at the backside thereof. The intermediate transfer unit 30 is inserted into the insertion hole 201*a*. A right backside-fitting hole 211 and a left backside-fitting hole 212 are formed in the backside frame 202. The right backside pin 112*a* of the intermediate transfer unit 30 is fitted into the right backside-fitting hole 211, and the left backside pin 112*b* thereof is fitted into the left backside-fitting hole 212.

A stick-shaped left front-side pin 221 that extends in the rotation axis direction is provided at the front-side frame 201. The hole 121 of the bracket 120 of the intermediate transfer unit 30 is formed with a size that allows the left front-side pin 221 to be loosely fitted into the hole 121.

When the intermediate transfer unit 30 configured in the aforementioned manner is positioned and fixed to the main body frame 200, the intermediate transfer unit 30 is inserted into the insertion hole 201*a* of the front-side frame 201 of the main body frame 200 from the front-side to the backside in the rotation axis direction while the side cover 150 is set to a opened state. At this time, the right backside pin 112*a* and the left backside pin 112*b* (refer to FIG. 2) of the intermediate transfer unit 30 are fitted into the right backside-fitting hole 211 formed in the backside frame 202 of the main body frame 200 and the left backside-fitting hole 212 formed in the backside frame 202 thereof, respectively. Moreover, the hole 121 of the bracket 120 of the intermediate transfer unit 30 is fitted over the left front-side pin 221 of the front-side frame 201 of the main body frame 200. In this manner, the intermediate transfer unit 30 is positioned to the main body frame 200 while being supported at the three support points before the intermediate transfer unit 30 is positioned and fixed to the main body frame 200.

After the intermediate transfer unit 30 is positioned by fitting the intermediate transfer unit 30 to the main body frame 200, that is, after the intermediate transfer unit 30 is attached to the main body frame 200, a not-shown front cover is fixed to the main body frame 200 by engaging a hook provided at the front cover with a groove formed at the main body frame 200, or by using a bolt. Then, the intermediate transfer unit 30 positioned at the main body frame 200 is positioned and fixed with respect to the main body frame 200 by fixing the front cover to the main body frame 200. More specifically, a right side hole (not shown) into which the front-side pin 111 of the intermediate transfer unit 30 is to be fitted, and a left side hole (not shown) into which the left front-side pin 221 of the front-side frame 201 of the main body frame 200 is to be fitted are formed in the front cover. Then, when the front cover is fixed to the main body frame 200, the right side hole and the left side hole are fitted over the front-side pin 111 of the intermediate transfer unit 30 and the left front-side pin 221 of the front-side frame 201 of the main body frame 200, respectively, while the front cover is fixed to the main body frame 200 by use of a bolt or the like. In this manner, the front cover is fixed to the main body frame 200 while the intermediate transfer unit 30 is positioned and fixed with respect to the main body frame 200.

Next, the secondary transfer unit 40 is described in more detail.

Figure 4:
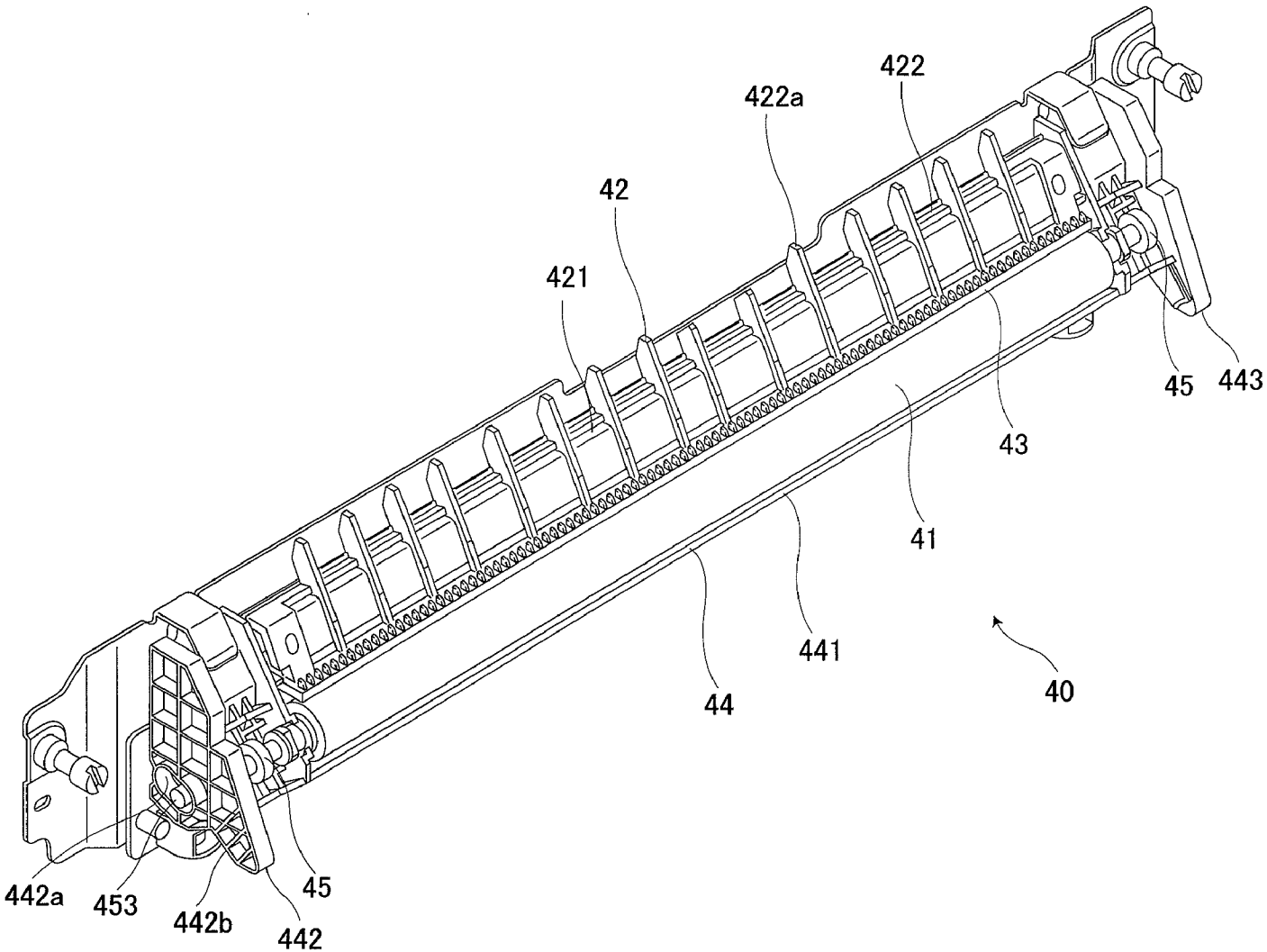
FIG. 4 is a perspective view of a secondary transfer unit.
Figure 5:
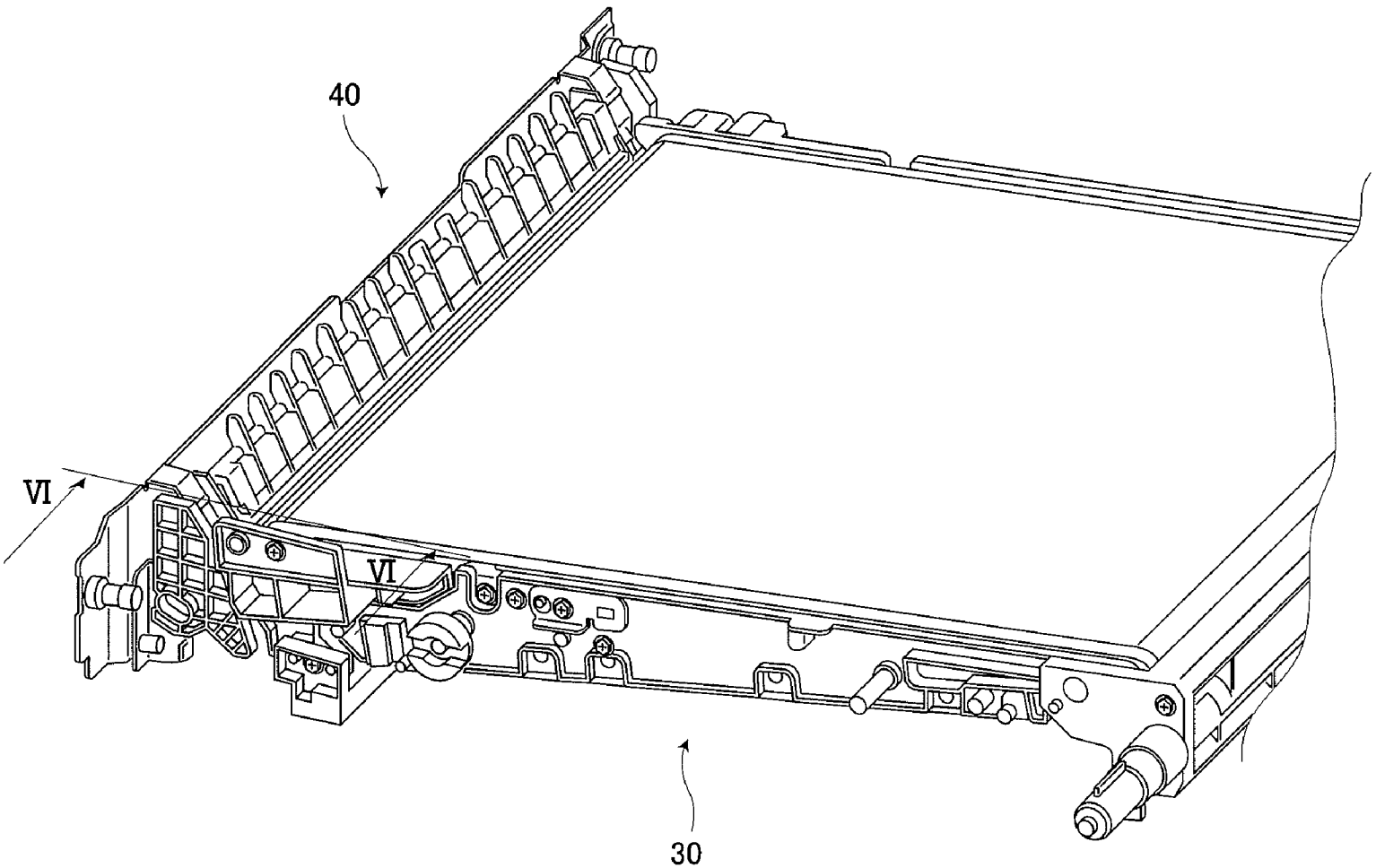
FIG. 5 is a perspective view showing a state where the intermediate transfer unit and the secondary transfer unit form a secondary transfer region.

FIG. 4 is a perspective view of the secondary transfer unit 40. FIG. 5 is a perspective view showing a state where the intermediate transfer unit 30 and the secondary transfer unit 40 form the secondary transfer region.

The secondary transfer unit 40 includes: the secondary transfer roller 41; a post-transfer guide member 42 that is provided downstream of the secondary transfer region in the sheet transport direction and guides the sheet having passed through the secondary transfer region to the downstream side; and a static eliminator 43 provided between the secondary transfer region and the post-transfer guide member 42.

As shown in FIG. 4, the post-transfer guide member 42 has: a support member 421 made of a conductive member such as a zinc-plated steel plate, for example; and a contact member 422 that is supported by the support member 421 and provided with several ribs 422*a* arranged to protrude toward the side where the secondary-transferred sheet passes and to continuously extend in the sheet transport direction. As the material of the contact member 422, a highly resistant material is used. In addition, in order to minimize the frictional charge, each of the ribs 422*a* may be formed into a shape having a small contact area with the sheet passing thereon, e.g., a shape having a sharp leading end.

The static eliminator 43 has: a plate-shaped static eliminating base 431 made of a conductive member such as SUS; and a support member 432 that supports the static eliminating base 431. A large number of needle-shaped electrodes 431*a* (refer to FIG. 9) each having a sharp leading end are arranged on the static eliminating base 431 on the side where the sheet passes. The static eliminating base 431 is attached so that the sharp leading ends of the needle-shaped electrodes 431*a* may be positioned backward, from the sheet transport path, of surfaces of ribs 432*a* on the side where the sheet passes, in order to keep the user's hands away from the static eliminating base 431, the ribs 432*a* being provided on the support member 432.

In addition, the secondary transfer unit 40 has: a housing 44 as an example of a holding unit that supports the secondary transfer roller 41, the post-transfer guide member 42 and the static eliminator 43 and the like and that is formed by a non-conductive resin member; and two cylindrical positioning members 45 as an example of a positioning portion that are attached on the rotation axis of the secondary transfer roller 41 and to regions outside of the secondary transfer roller 41.

The housing 44 is constituted by a center housing 441, a front-side housing 442 and a backside housing 443. The center housing 441 extends in the axial direction of the secondary transfer roller 41 and supports the secondary transfer roller 41, the post-transfer guide member 42 and the static eliminator 43. The front-side housing 442 is positioned at the front side as viewed in FIG. 1 and is formed to extend orthogonal to the axial direction of the secondary transfer roller 41. The backside housing 443 is positioned at the backside as viewed in FIG. 1, and is formed to extend orthogonal to the axial direction of the secondary transfer roller 41. A long hole 442*a* through which a later-described support shaft 453 is inserted is respectively provided at each of the front-side housing 442 and the backside housing 443. In addition, a V-shaped contact portion 442*b* as an example of a contact portion that is to be brought into contact with a cylindrical member 203 (refer to FIGS. 15A and 15B) is formed at a lower portion of each of the front-side housing 442 and the backside housing 443, the cylindrical member 203 being fixed to the main body frame 200.

Figure 6:
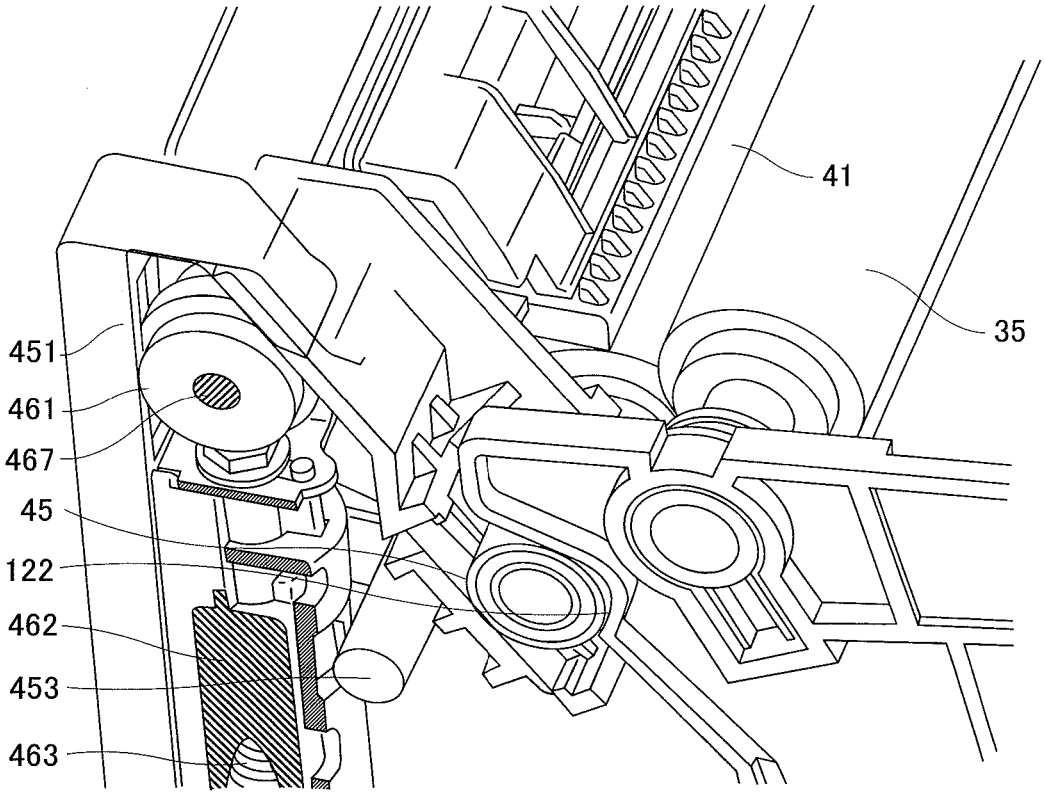
FIG. 6 is a partial cross-sectional view showing a state where positioning members are fitted into positioning grooves.

As described later, the positioning members 45 are fitted into the positioning grooves 122 formed at the brackets 120 of the intermediate transfer unit 30, thereby determining the position of the secondary transfer roller 41 with respect to the backup roller 35 so that the distance between the rotation axis center of the backup roller 35 and the rotation axis center of the secondary transfer roller 41 may be a predetermined distance. FIG. 6 is a partial cross-sectional view showing the state where the positioning members 45 are fitted into the positioning grooves 122. In other words, FIG. 6 is a cross-sectional view taken along the line VI-VI of FIG. 5.

The secondary transfer unit 40 configured in the above-described manner is rotatably supported against the side cover 150. The side cover 150 is one of the component parts of a cover unit 300 as an example of an apparatus exterior unit which forms the exterior of the image forming apparatus 1.

Figure 7:
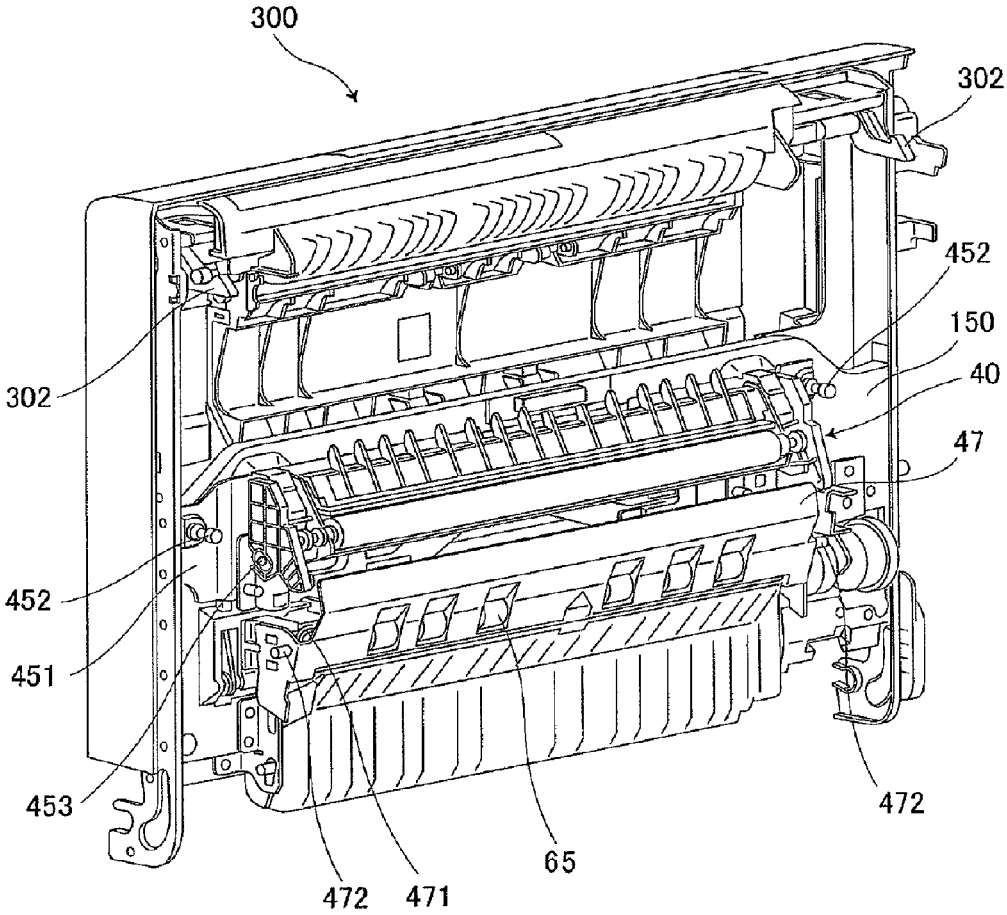
FIG. 7 is a perspective view of a cover unit as viewed from a side where the secondary transfer unit is arranged.

FIG. 7 is a perspective view of the cover unit 300 as viewed from a side where the secondary transfer unit 40 is arranged.

The cover unit 300 has the side cover 150. A support plate 451 obtained by subjecting a conductive member such as a zinc-plated steel plate to a folding process is screwed to the side cover 150 by at least two bolts 452, the support plate 451 rotatably supporting the secondary transfer unit 40.

In addition, the support shaft 453 that extends in the axial direction of the secondary transfer roller 41 is attached to the support plate 451. The support shaft 453 is inserted through the long holes 442*a* formed at the front-side housing 442 and the backside housing 443 of the secondary transfer unit 40, thereby tentatively holding the secondary transfer unit 40.

In addition, force-applying units 46 (refer to FIG. 8) provided as an example of a force-applying unit that applies a rotation force to the secondary transfer unit 40 in a clockwise direction as viewed in FIG. 1 are attached to the both sides of the support plate 451 in the axial direction of the secondary transfer roller 41 and outside of the secondary transfer roller 41.

Figure 8:
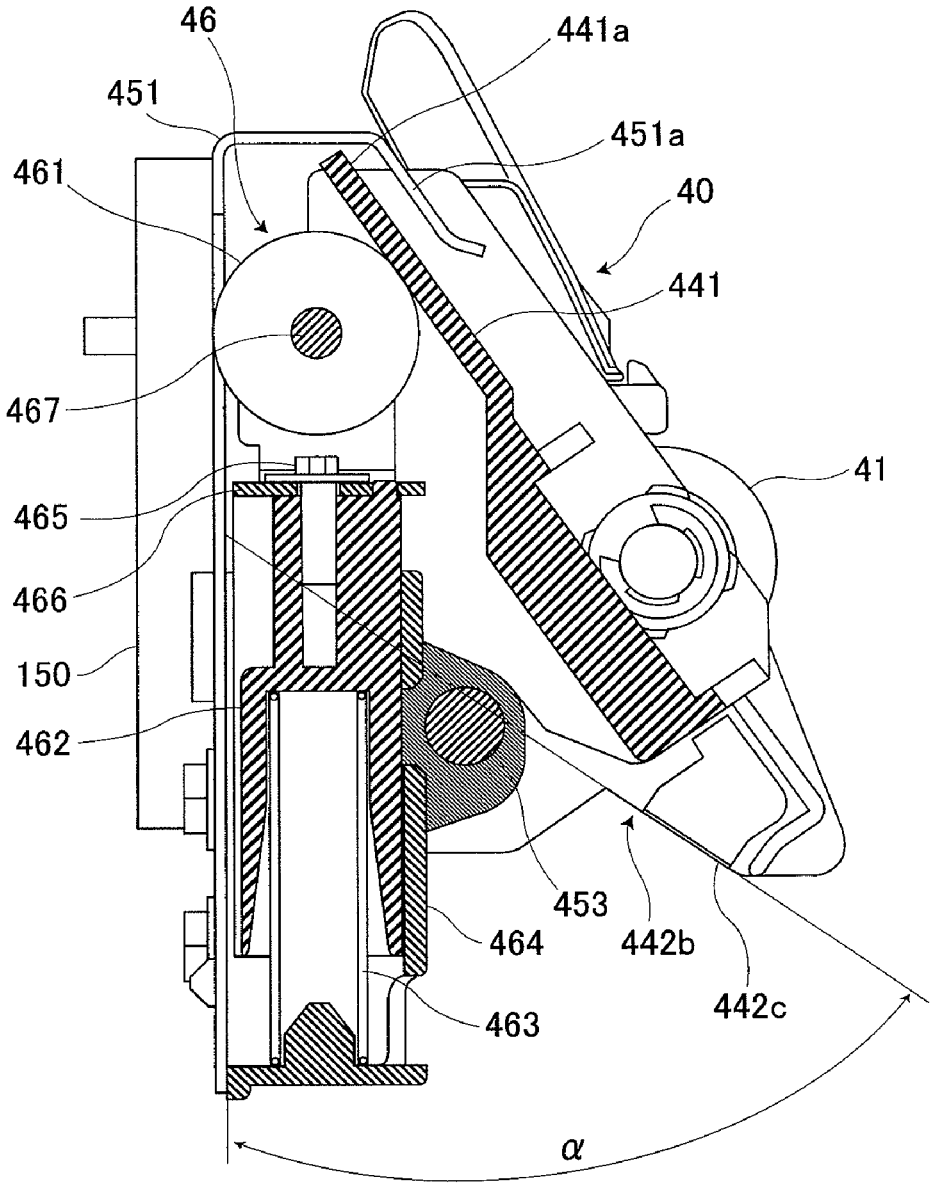
FIG. 8 is a cross-sectional view of a force-applying unit.

FIG. 8 is a cross-sectional view of the force-applying unit 46.

As shown in FIG. 8, each of the force-applying units 46 includes: a pressing member 461 as an example of a pressing unit that is in contact with an inclined surface portion 441*a* that is a part of the center housing 441; a slider 462 that is located below the pressing member 461 and that vertically moves; a coil spring 463 as an example of an elastic member that applies a force in the vertical direction to the slider 462; and a cover 464 that covers the slider 462 and the coil spring 463. A pressing-member supporting member 466 that is formed in a U-shape in a cross-section, that is fixed to the slider 462 by a bolt 465, and that supports the pressing member 461 is provided over the slider 462. The pressing member 461 is fitted over a support shaft 467 provided from one side of the U-shaped pressing-member supporting member 466 to the other side thereof. Here, the cover 464 is attached to the support plate 451.

In addition, restricting portions 451*a* that restrict the secondary transfer unit 40 from rotating in the clockwise direction as viewed in FIG. 8 are provided to portions of the support plate 451 above the respective two force-applying units 46. Each of the restricting portions 451*a* sandwiches the inclined surface portion 441*a* of the center housing 441 between the restricting portion 451*a* and the pressing member 461, thereby restricting the inclined surface portion 441*a* from rotating in the clockwise direction.

Two torsion coil springs provided as an example of an elastic member that maintains the inclination of the secondary transfer unit 40 with respect to the side cover 150 are arranged between the support plate 451 and the secondary transfer unit 40 in the width direction so that an angle $\alpha$ formed by a side 442*c* and the surface of the support plate 451 may be equal to or greater than a predetermined angle, the side 442*c* being one side of each of the V-shaped contact portions 442*b* provided at the lower portions of the front-side housing 442 and the backside housing 443. In other words, each of the two torsion coil springs serves as an example of the elastic member that maintains the posture (inclination) of the secondary transfer unit 40 with respect to the side cover 150 so that the angle $\alpha$ formed by the side 442*c* and the surface of the support plate 451 may be equal to or greater than the predetermined angle, the side 442*c* being one side of each of the V-shaped contact portions 442*b* provided at the lower portions of the front-side housing 442 and the backside housing 443. Hereinafter, of the two torsion coil springs, the torsion coil spring arranged at the right side as viewed in FIG. 4, i.e., at the backside of the apparatus is referred to as a torsion coil spring 251, and the torsion coil spring arranged at the left side as viewed in FIG. 4, i.e., at the front side of the apparatus is referred to as a torsion coil spring 252.

Figure 9:
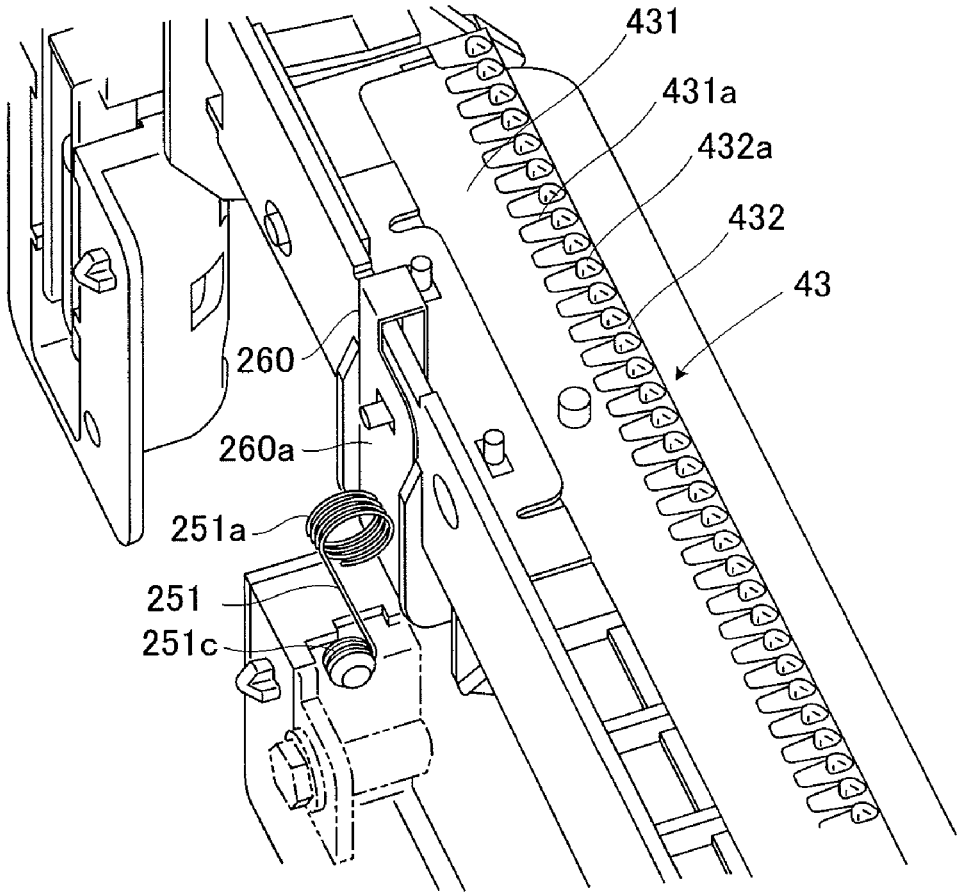
FIG. 9 is a diagram showing how a torsion coil spring is attached at the backside of the apparatus, as viewed from above a support plate.
Figure 10:
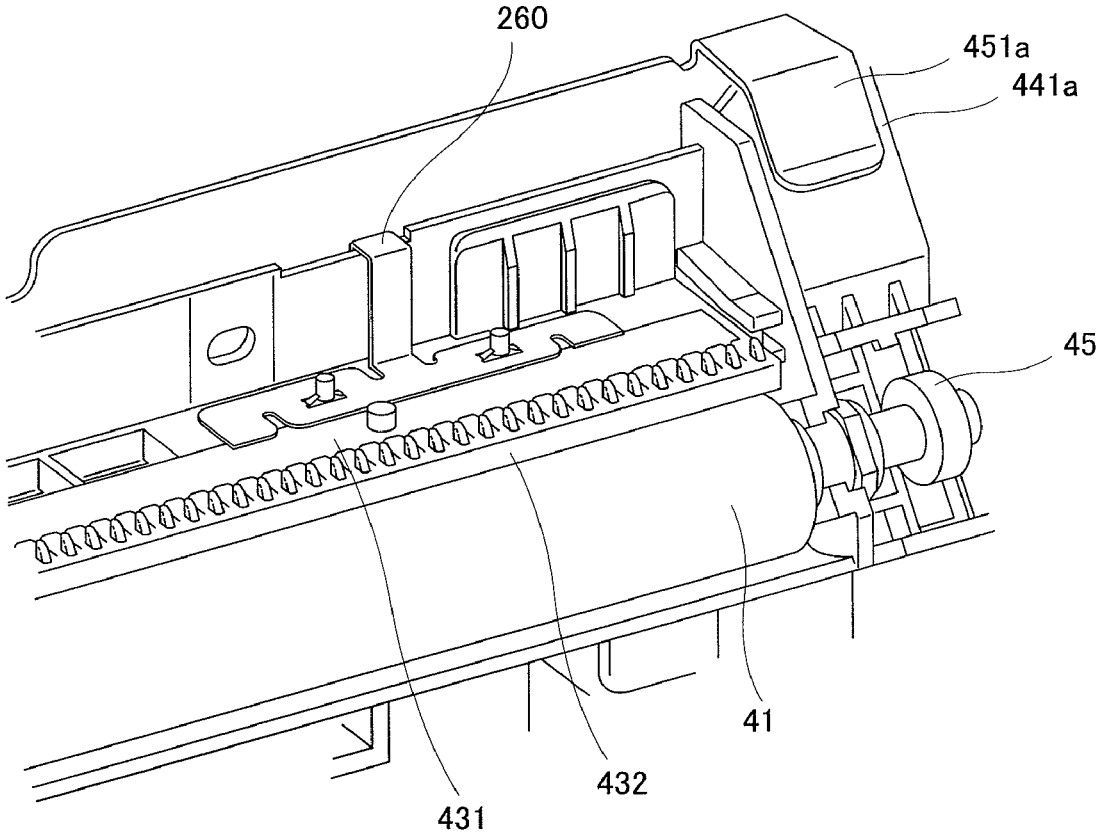
FIG. 10 is a diagram showing a state where a plate spring and a static eliminating base are in contact with each other.
Figure 11:
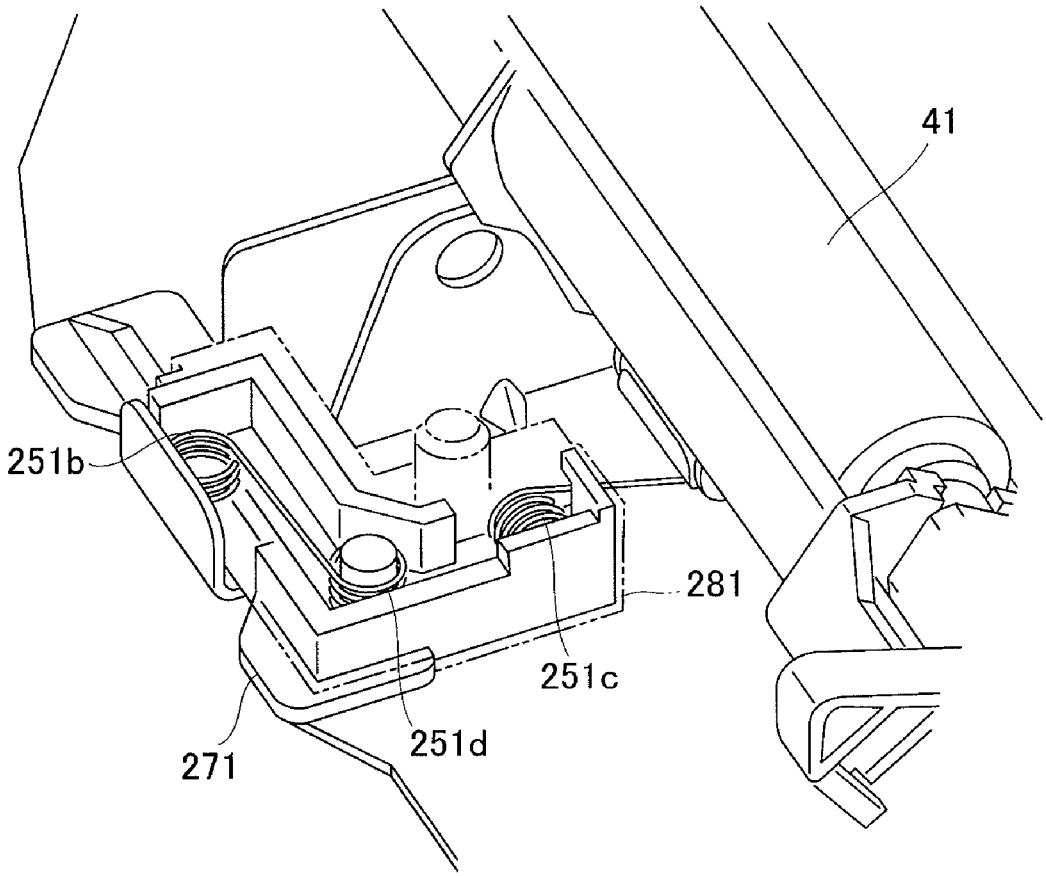
FIG. 11 is a diagram showing how the torsion coil spring is attached at the backside of the apparatus, as viewed from a lower side of the backside of the apparatus.

FIG. 9 is a diagram showing how the torsion coil spring 251 is attached at the backside of the apparatus, as viewed from above the support plate 451. Note that, FIG. 9 shows the apparatus while the support plate 451, the post-transfer guide member 42 and the like are omitted. FIG. 10 is a diagram showing a state where a later-described plate spring 260 and the static eliminating base 431 are in contact with each other. Note that, FIG. 10 shows the apparatus while the post-transfer guide member 42 is omitted. FIG. 11 is a diagram showing how the torsion coil spring 251 is attached at the backside of the apparatus, as viewed from a lower side of the backside of the apparatus. Note that, FIG. 11 shows the apparatus while the support shaft 453 is omitted.

As shown in FIG. 9, one end portion 251*a* of the torsion coil spring 251 is in the form of a coil, and the one end portion 251*a* is in contact with the surface of the center housing 441 on the support plate 451 side. More specifically, as shown in FIG. 10, the plate spring 260 formed by subjecting a conductive member such as a zinc-plated steel plate to a folding process is attached to the center housing 441 so as to urge the static eliminating base 431 of the static eliminator 43 against the support plate 432 by directly pressing the static eliminating base 431 of the static eliminator 43. Then, the one end portion 251*a* is in contact with an outer surface 260*a* of the plate spring 260.

Moreover, as shown in FIG. 11, the other end portion 251*b* of the torsion coil spring 251 is in the form of a coil, and the other end portion 251*b* is in contact with the support plate 451. A first coil portion 251*c* and a second coil portion 251*d* are provided between the one end portion 251*a* and the other end portion 251*b* of the torsion coil spring 251. The first coil portion 251*c* is in the form of a coil and its centerline extends in the axial direction of the secondary transfer roller 41. The second coil portion 251*d* is in the form of a coil and its centerline extends in the direction orthogonal to the plate surface of the support plate 451. The first coil portion 251*c* and the second coil portion 251*d* are supported at protruding portions formed at a first spring support member 271 attached to the support plate 451. Moreover, a first spring cover 281 is attached to the support plate 451 so as to cover the first coil portion 251*c* and the second coil portion 251*d*. Each of the first spring support member 271 and the first spring cover 281 is formed of a non-conductive member such as resin.

Figure 12:
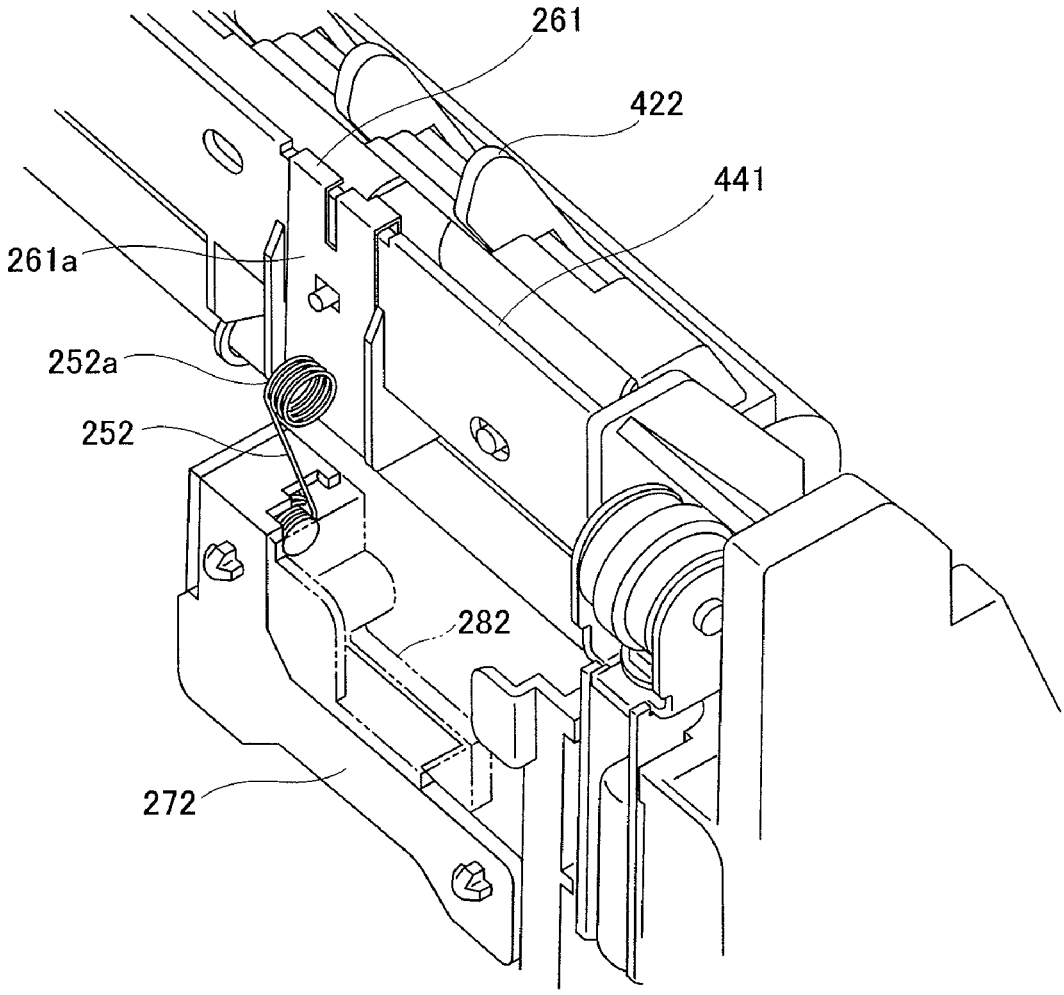
FIG. 12 is a diagram showing how the torsion coil spring is attached at the front side of the apparatus, as viewed from above the support plate.
Figure 13:
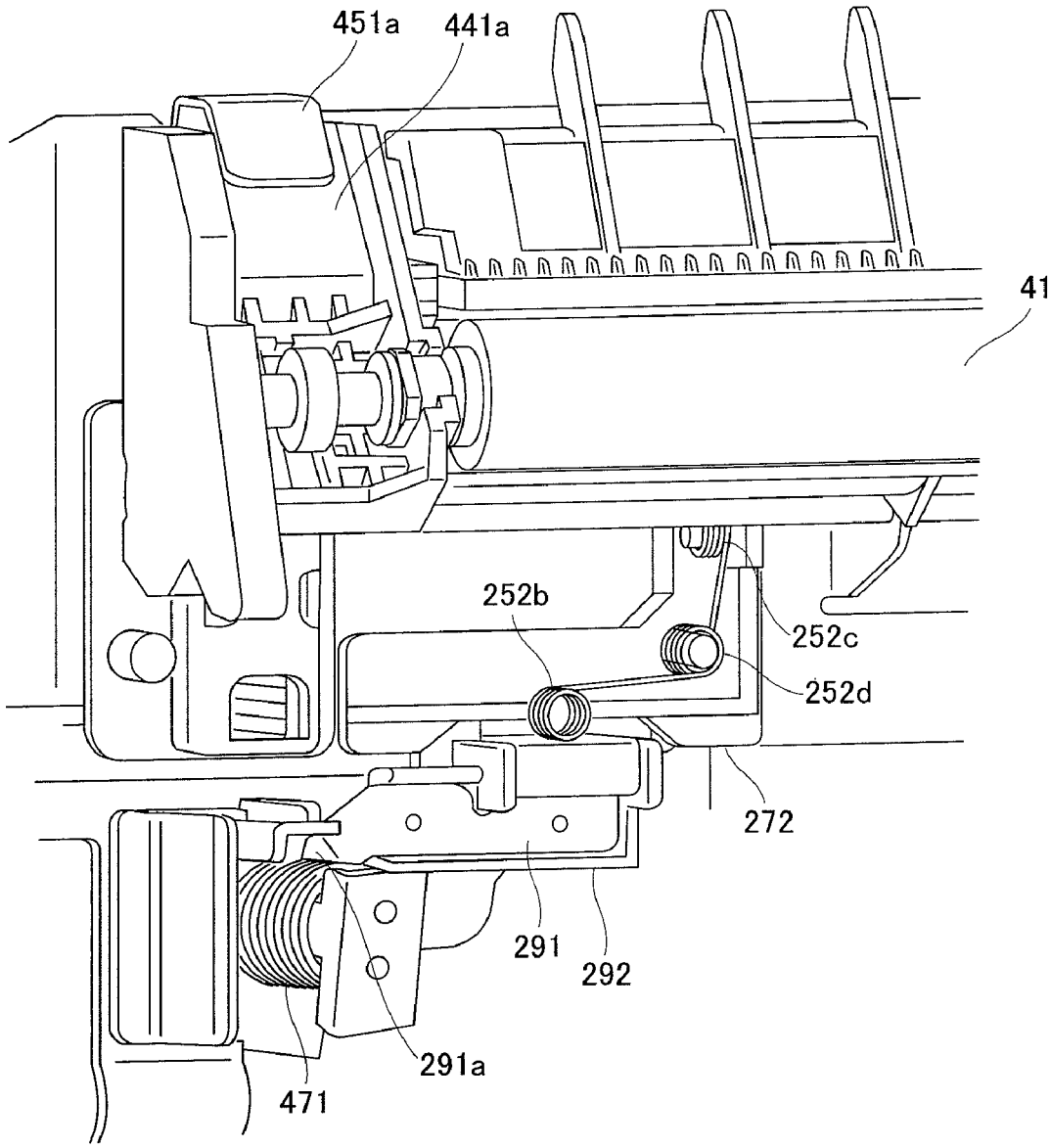
FIG. 13 is a diagram showing how the torsion coil spring is attached at the front side of the apparatus, as viewed from the intermediate transfer unit side.

FIG. 12 is a diagram showing how the torsion coil spring 252 is attached at the front side of the apparatus, as viewed from above the support plate 451. Note that, FIG. 12 shows the apparatus while the support plate 451 is omitted. FIG. 13 is a diagram showing how the torsion coil spring 252 is attached at the front side of the apparatus, as viewed from the intermediate transfer unit 30 side. Note that, FIG. 13 shows the apparatus while a later-described pre-transfer guide member 47 is omitted.

As shown in FIG. 12, one end portion 252*a* of the torsion coil spring 252 is in the form of a coil, and the one end portion 252*a* is in contact with the surface of the center housing 441 on the support plate 451 side. More specifically, a folded member 261 obtained by forming a conductive member such as a zinc-plated steel plate into a U-shape by subjecting the conducting member to a folding process is attached to the center housing 441. Then, the one end portion 252*a* is in contact with an outer surface 261*a* that is one side of the U-shaped folded member 261. Note that, the other side of the U-shaped folded member 261 is in contact with the support member 421 of the post-transfer guide 42.

Moreover, as shown in FIG. 13, the other end portion 252*b* of the torsion coil spring 252 is in the form of a coil, and the other end portion 252*b* is in contact with a conducive member 291 formed by subjecting a conductive member such as a zinc-plated steel plate to a folding process. A third coil portion 252*c* and a fourth coil portion 252*d* are provided between the one end portion 252*a* and the other end portion 252*b* of the torsion coil spring 252. The third coil portion 252*c* is in the form of a coil and its centerline extends in the axial direction of the secondary transfer roller 41. The fourth coil spring 252*d* is in the form of a coil and its centerline extends in the direction orthogonal to the plate surface of the support plate 451. The third coil portion 252*c* and the fourth coil portion 252*d* are supported at protruding portions formed at a second spring support member 272 attached to the support plate 451. Here, a second spring cover 282 is attached to the support plate 451 so as to cover the third coil portion 252*c* and the fourth coil portion 252*d*. Each of the second spring support member 272 and the second spring cover 282 is formed of a non-conductive member such as resin. The conductive member 291 is supported at a conductive-member supporting member 292 that is attached to the support plate 451 and formed of a non-conductive member such as resin. Moreover, an end portion 291*a* of the conductive member 291 is in contact with a later-described coil spring 471, the end portion 291*a* being different from an end portion of the conductive member 291, which is in contact with the other end portion 252*b* of the torsion coil spring 252.

With the aforementioned configuration, the torsion coil springs 251 and 252 support the secondary transfer unit 40 so that a predetermined inclination of the secondary transfer unit 40 with respect to the side cover 150 may be maintained.

The torsion coil spring 251 also has a function to ground the static eliminating base 431 of the static eliminator 43 via the side cover 150. Specifically, the static eliminating base 431 of the static eliminator 43 is electrically conducted with the support plate 451 via the plate spring 260 and the torsion coil spring 251. Then, the support plate 451 is fastened to the grounded side cover 150 by the bolts 452.

The torsion coil spring 252 also has a function to ground the post-transfer guide member 42 via a high resistor.

First, the pre-transfer guide member 47 is described. As shown in FIG. 7, the pre-transfer guide member 47 is attached to the side cover 150. The pre-transfer guide member 47 is provided as an example of a guide portion that is provided upstream of the second transfer region in the sheet transport direction and that guides a sheet towards the secondary transfer region. The pre-transfer guide member 47 forms the transport path 64 with a facing member (not shown) attached to the main body frame 200 side and thus guides the sheet. In addition, one of the pair of registration rollers 65 is attached to the side cover 150 at a portion in the middle of the transport path 64 formed by the pre-transfer guide member 47. Note that, the other one of the registration rollers 65 is attached to the main body frame 200 side.

The coil spring 471 is provided between the pre-transfer guide member 47 and the side cover 150. The pre-transfer guide member 47 is pressed by the coil spring 471, and is thereby urged towards the facing member (not shown) that forms the transport path 64 with the pre-transfer guide member 47. The pre-transfer guide member 47 is connected to a high resistor (not shown), and the high resistor is grounded to the side cover 150. Thus, the pre-transfer guide member 47 is grounded via the high resistor, i.e., is grounded through high resistance.

The support member 421 of the post-transfer guide member 42 is electrically conducted with the pre-transfer guide member 47 via the folded member 261, the torsion coil spring 252, the conductive member 291 and the coil spring 471, so that, as in the case of the pre-transfer guide member 47, the post-transfer guide member 42 is grounded via the high resistor, i.e., is grounded through high resistance.

Figure 14:
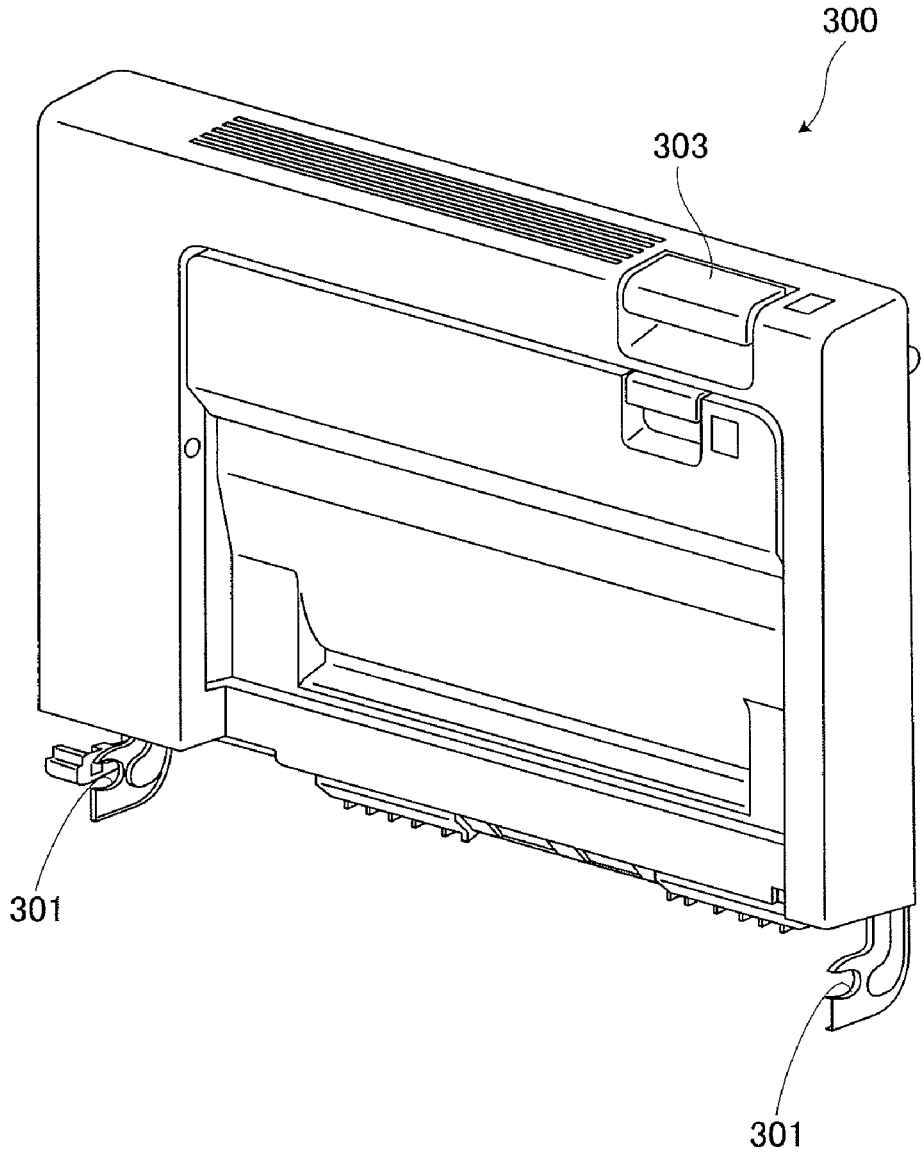
FIG. 14 is an external view of the cover unit.

FIG. 14 is an external view of the cover unit 300.

As described above, the cover unit 300 that holds the side cover 150, to which the secondary transfer unit 40 and the pre-transfer guide member 47 are attached, rotates with respect to the main body frame 200 in the counterclockwise direction as viewed in FIG. 1, thereby turning from a closed state shown in FIG. 1 into an opened state where the transport path 64 is released. At this time, recessed portions 301 provided at the both sides of the cover unit 300 in the width direction are fitted over a rotation shaft (not shown) provided to the main body frame 200, and the cover unit 300 thereby rotates about the rotation shaft.

As shown in FIG. 7, hooks 302 are provided to the both sides of the cover unit 300 in the width direction. In a case where the cover unit 300 is in the closed state shown in FIG. 1, the hooks 302 are connected to grooves (not shown) provided at the main body frame 200, thereby connecting the cover unit 300 to the main body frame 200. Then, as shown in FIG. 14, an open and close lever 303 that rotates the hooks 302 to release the connection between the cover unit 300 and the grooves provided at the main body frame 200 is provided at an upper right portion of the cover unit 300. Accordingly, the user is allowed to open the cover unit 300 by rotating the open and close lever 303 upward. In addition, when closing the cover unit 300, the user presses an upper portion of the cover unit 300. Thus, the hooks 302 of the cover unit 300 are fitted into the grooves provided at the main body frame 200, thereby turning the cover unit 300 to the closed state.

In the image forming apparatus 1 configured in the above-described manner, when the cover unit 300 transitions to the closed state from the opened state, the cover unit 300 operates as follows.

Firstly, when the cover unit 300 is rotated in order to turn the state of the cover unit 300 into the closed state, the contact portions 442*b* of the front-side housing 442 and the backside housing 443 of the secondary transfer unit 40 start to be brought into contact with the cylindrical member 203 (refer to FIGS. 15A and 15B) as an example of a counterpart contact member that is fixed to the main body frame 200.

When the cover unit 300 is rotated further, the positioning members 45 of the secondary transfer unit 40 are fitted into the positioning grooves 122 formed at the brackets 120 of the intermediate transfer unit 30. Thereafter, when the cover unit 300 is rotated further, the following forces are applied to the secondary transfer unit 40. Specifically, in the secondary transfer unit 40, the positioning members 45 receive a force through the positioning grooves 122, and the contact portions 442*b* receive a force through the cylindrical member 203 (refer to FIGS. 15A and 15B) fixed to the main body frame 200. In addition, the inclined surface portion 441*a* receives a force through each pressing member 461. Meanwhile, the pressing members 461 of the force-applying units 46 receive a reactive force from the inclined surface portion 441*a*.

Then, when the cover unit 300 is rotated further and the force received by the pressing members 461 of the force-applying units 46 from the inclined surface portion 441*a* becomes greater than the spring force of the coil springs 463, the secondary transfer unit 40 rotates with the center axis of the cylindrical member 203 as the center of rotation (support point) in the counterclockwise direction with respect to the side cover 150, the cylindrical member 203 fixed to the main body frame 200.

FIGS. 15A to 17B are diagrams simply showing a change in the state of the secondary transfer unit 40 in a case where the cover unit 300 transitions from the opened state to the closed state.

Figure 15A:
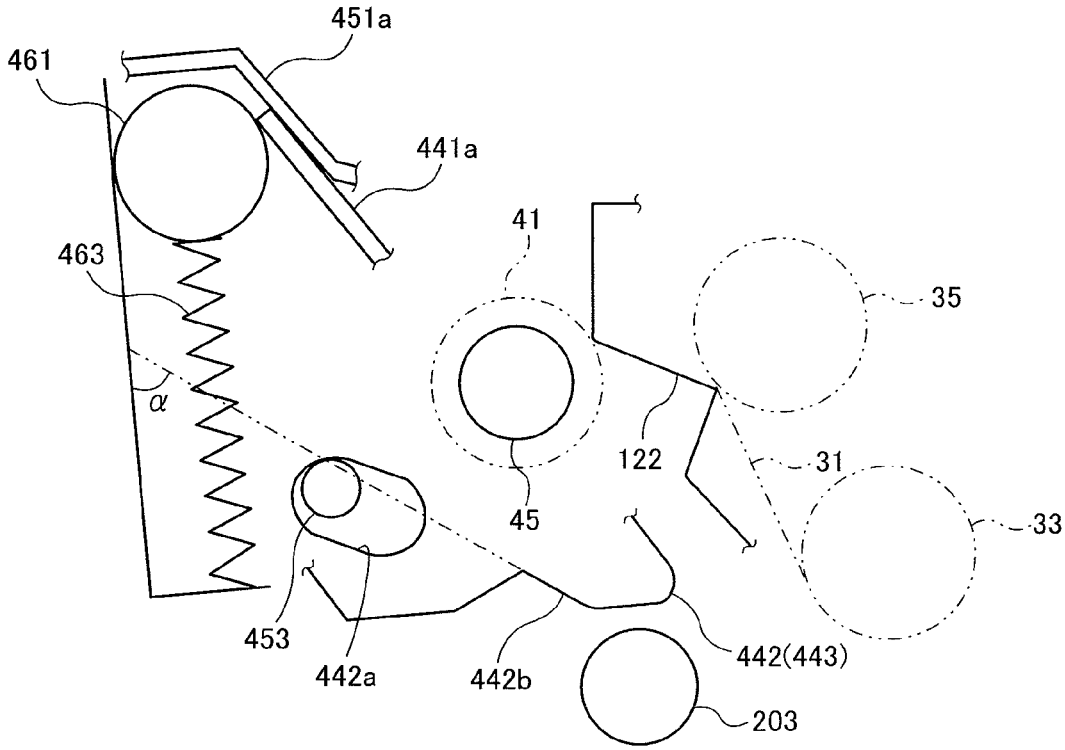
FIGS. 15A and 15B are diagrams simply showing a change in the state of the secondary transfer unit in a case where the cover unit transitions from an opened state to a closed state.

FIG. 15A shows a state before the contact portions 442*b* of the front-side housing 442 and the backside housing 443 of the secondary transfer unit 40 start to come into contact with the cylindrical member 203 fixed to the main body frame 200. As shown in FIG. 15A, when the secondary transfer unit 40 is in a state where the secondary transfer unit 40 is not in contact with the intermediate transfer unit 30 or the main body frame 200, the secondary transfer unit 40 is restrained from falling off because the long holes 442*a* formed at the front-side housing 442 and the backside housing 443 are in contact with the support shaft 453. At this time, the inclined surface portion 441*a* receiving the force through the pressing members 461 of the force-applying units 46 is restricted by the restricting portions 451*a* of the support plate 451 from rotating in the counterclockwise direction. In addition, the posture of the secondary transfer unit 40 with respect to the side cover 150 is maintained by the torsion coil spring 251 and the torsion coil spring 252 so that the angle $\alpha$ formed by the side 442*c* and the surface of the support plate 451 may be equal to or greater than a predetermined angle, the torsion coil spring 251 and the torsion coil spring 252 being arranged at the backside and the front-side of the apparatus, respectively, the side 442*c* being one side of each of the V-shaped contact portions 442*b* provided at the lower portions of the front-side housing 442 and the backside housing 443.

Figure 15B:
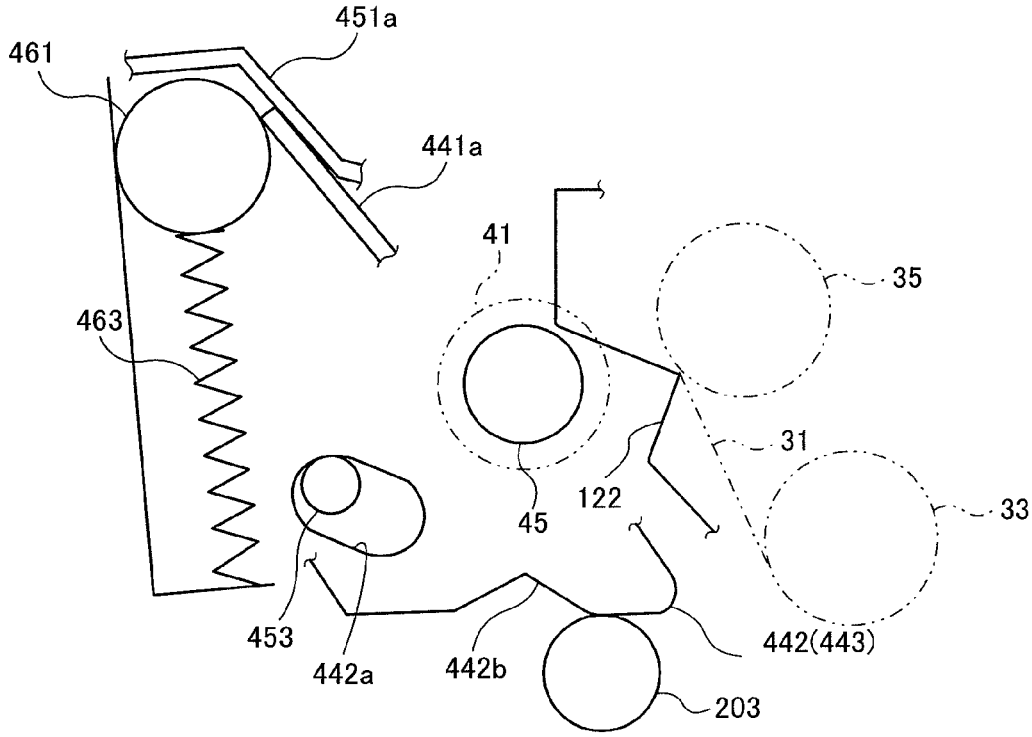

Thereafter, when the cover unit 300 is rotated, the contact portions 442*b* of the front-side housing 442 and the backside housing 443 start to contact with the cylindrical member 203 as shown in FIG. 15B. Here, the predetermined angle described above at or greater than which the angle • formed by the side 442*c* and the surface of the support plate 451 is maintained is equal to or greater than the angle at which the contact portions 442*b* contact with the cylindrical member 203 when the cover unit 300 is turned into the closed state, the side 442*c* being one side of each of the V-shaped contact portions 442*b* of the front-side housing 442 and the backside housing 443. Specifically, if the formed angle • is less than the predetermined angle, a region on the right side of each of the contact portions 442*b* of the front-side housing 442 and the backside housing 443 hits the cylindrical member 203, so that the contact portions 442*b* do not contact with the cylindrical member 203.

Figure 16A:
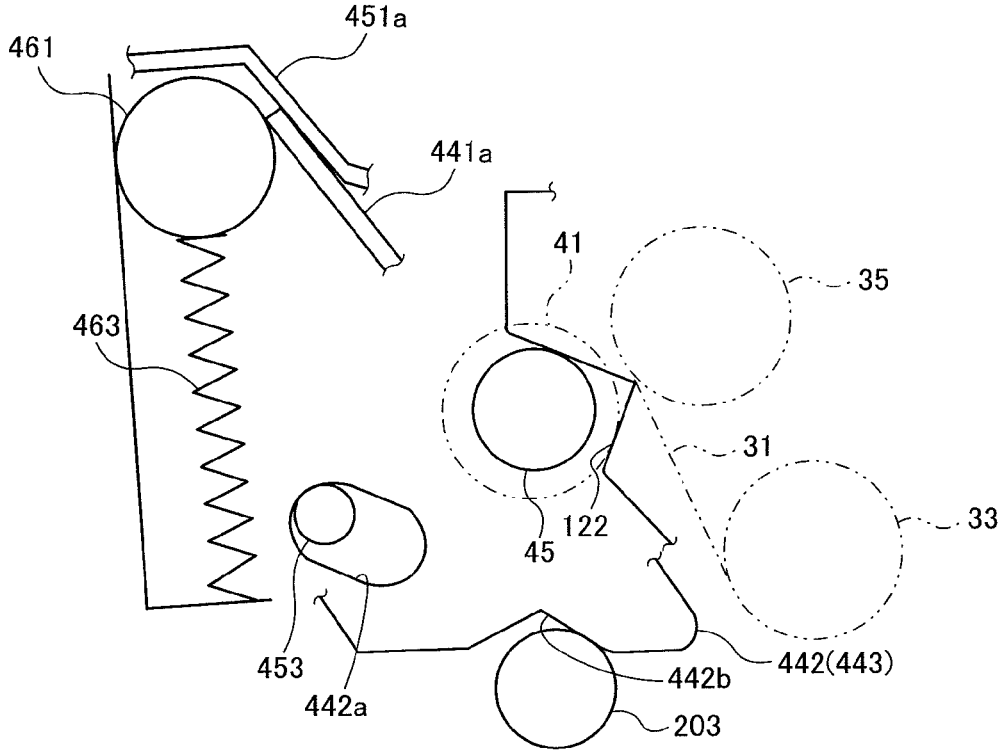
FIGS. 16A and 16B are diagrams simply showing a change in the state of the secondary transfer unit in a case where the cover unit transitions from the opened state to the closed state.

Then, when the cover unit 300 is further rotated from the state shown in FIG. 15B, the contact portions 442*b* of the front-side housing 442 and the backside housing 443 come into contact with the cylindrical member 203, and the positioning members 45 supported at the center housing 441 start to come into contact with the positioning grooves 122 formed at the brackets 120 of the intermediate transfer unit 30 as shown in FIG. 16A. Specifically, the secondary transfer unit 40 employs a configuration in which, because the angle $\alpha$ is maintained to be equal to or greater than the predetermined angle, the posture of the secondary transfer unit 40 is maintained so as to allow the region on the right side of each of the contact portions 442*b* of the front-side housing 442 and the backside housing 443 to cross over the cylindrical member 203, and the contact portions 442*b* come into contact with the cylindrical member 203 after the region on the right side of each of the contact portions 442*b* crosses over the cylindrical member 203.

Figure 16B:
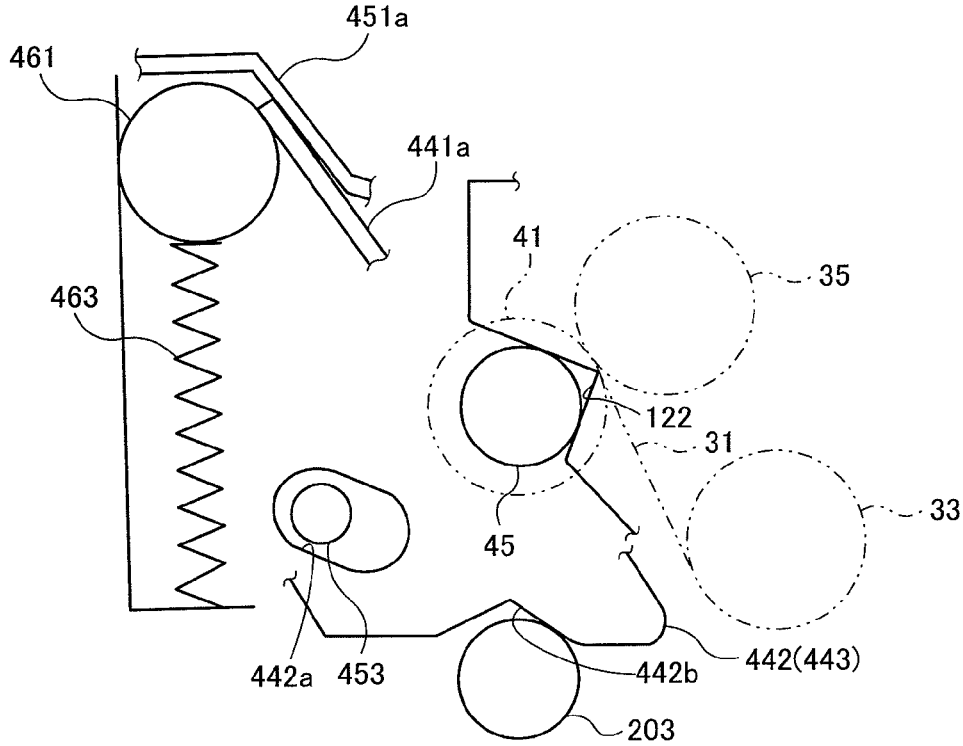

Thereafter, when the cover unit 300 is further rotated, the positioning members 45 supported at the center housing 441 are fitted into the positioning grooves 122 formed at the brackets 120 of the intermediate transfer unit 30, and each of the positioning members 45 comes into contact with the two sides of the corresponding V-shaped positioning groove 122 as shown in FIG. 16B. In this manner, the secondary transfer unit 40 is positioned with respect to the intermediate transfer unit 30. In this state, the contact portions 442*b* of the front-side housing 442 and the backside housing 443 receive a force through the cylindrical member 203 fixed to the main body frame 200, so that the posture of the intermediate transfer unit 30 is maintained while the long holes 442*a* are not brought into contact with the support shaft 453, even when the inclined surface portion 441*a* receives a force through the pressing members 461.

Figure 17A:
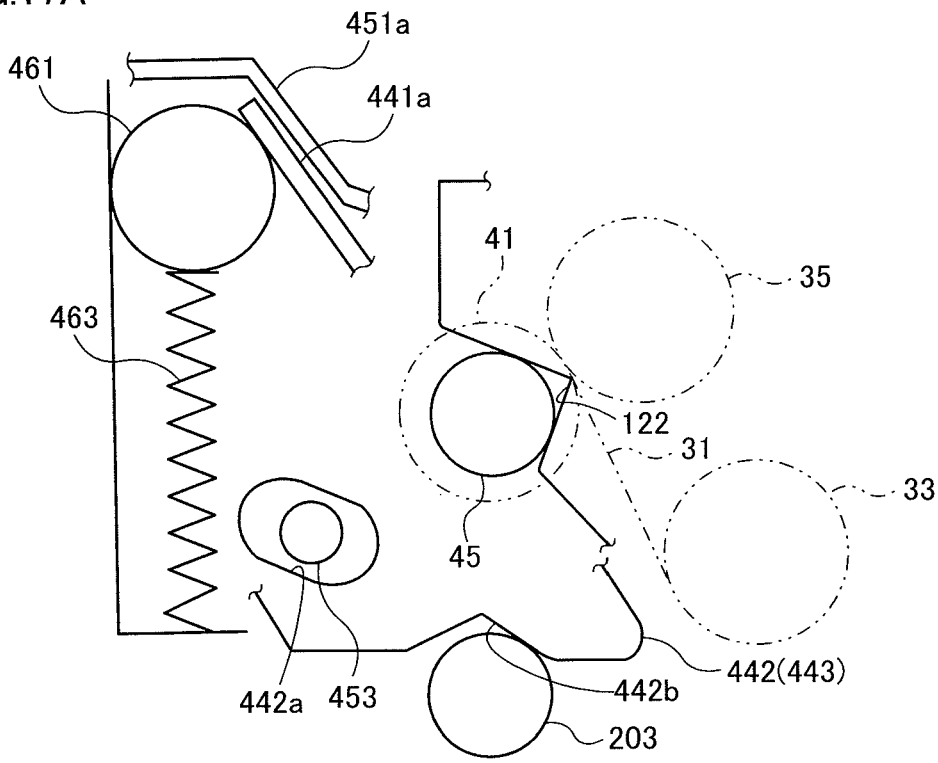
FIGS. 17A and 17B are diagrams simply showing a change in the state of the secondary transfer unit in a case where the cover unit transitions from the opened state to the closed state.

Thereafter, when the cover unit 300 is further rotated, while the side cover 150 attempts to rotate in the clockwise direction, the secondary transfer unit 40 is unable to rotate in the clockwise direction because of the positioning grooves 122 of the intermediate transfer unit 30 fixed to the main body frame 200. As a result, as shown in FIG. 17A, the force received by the pressing members 461 of the force-applying units 46 from the inclined surface portion 441*a* of the center housing 441 becomes greater than the spring force of the coil springs 463. Accordingly, the secondary transfer unit 40 rotates with the center axis of the cylindrical member 203 as the center of rotation (support point) in the counterclockwise direction with respect to the side cover 150, the cylindrical member 203 fixed to the main body frame 200. In other words, the side cover 150 rotates in the clockwise direction with respect to the secondary transfer unit 40.

Figure 17B:
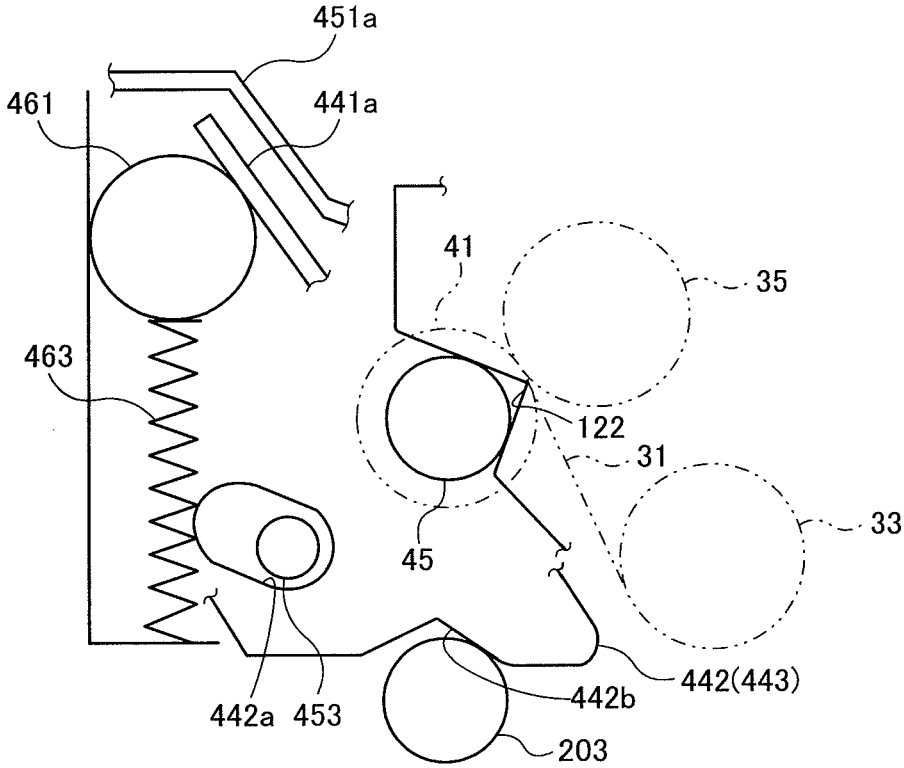

FIG. 17B is a diagram showing the cover unit 300 in the closed state. When the cover unit 300 is further rotated from the state shown in FIG. 17A, while the side cover 150 attempts to further rotate in the clockwise direction, the pressing members 461 receive a force from the inclined surface portion 441*a* of the center housing 441 and thereby compress the coil springs 463 because the secondary transfer unit 40 is fixed to the main body frame 200. Then, the side cover 150 further rotates in the clockwise direction with respect to the secondary transfer unit 40. Then, the hooks 302 of the cover unit 300 are fitted into the grooves provided at the main body frame 200. Thus, the cover unit 300 becomes the closed state.

Next, a description is given of a force required to turn the cover unit 300 in the image forming apparatus 1 configured in the aforementioned manner into the closed state.

First, focusing on the force required to position the secondary transfer unit 40, the secondary transfer unit 40 does not receive any force from the main body frame 200 until the positioning members 45 supported at the center housing 441 of the secondary transfer unit 40 are fitted into the positioning grooves 122 formed at the brackets 120 of the intermediate transfer unit 30, and then, each of the positioning members 45 is brought into contact with the two sides of the corresponding V-shaped positioning groove 122. In other words, the side cover 150 does not receive any force from the secondary transfer unit 40 except for the force to support the secondary transfer unit 40 at the supporting shaft 453.

After the positioning members 45 are brought into contact with the positioning grooves 122, the cover unit 300 needs to be rotated against the force with which the inclined surface portion 441*a* of the center housing 441 presses the pressing members 461 of the force-applying units 46, i.e., the force received from the coil springs 463. For this reason, the force required to rotate the cover unit 300 in the closing direction becomes large accordingly.

Considering the magnitude of the force, the magnitude of the aforementioned force is small as compared with a force required to turn the cover unit 300 into the closed state in an apparatus that employs, for example, a configuration in which the secondary transfer roller 41 is attached to the side cover 150 via a coil spring, and the secondary transfer roller 41 presses the backup roller 35 with the intermediate transfer belt 31 interposed therebetween when the cover unit 300 is closed (hereinafter, referred to as a "comparison apparatus"). Specifically, in this case, the cover unit 300 needs to be rotated against the reactive force received by the secondary transfer roller 41 from the backup roller 35 with the intermediate transfer belt 31 interposed therebetween.

In contrast to the comparison apparatus, in the image forming apparatus 1 according to the present exemplary embodiment, the force acting on the center housing 441 of the secondary transfer unit 40 is the force that the positioning members 45 receive through the positioning grooves 122, i.e., the force that the center housing 441 receives through the support shaft of the positioning members 45 and the force that the inclined surface portion 441*a* receives through the pressing members 461. Then, the center housing 441 rotates about the center axis of the cylindrical member 203 fixed to the main body frame 200. Thus, because of the balance of the moment of force about the center axis of the cylindrical member 203, which occurs on the secondary transfer unit 40, the force generated at the contact region between the inclined surface portion 441*a* and the pressing members 461 is smaller than the force generated in a second contact region where the positioning members 45 and the positioning grooves 122 come into contact with each other. Here, the distance from the center axis of the cylindrical member 203 to the contact region is longer than the distance from the center axis of the cylindrical member 203 to the second contact region. Accordingly, if the magnitude and direction of the force that the secondary transfer roller 41 receives from the backup roller 35 in the comparison apparatus and the magnitude and direction of the force that the center housing 441 receives from the support shaft of the positioning members 45 in the present exemplary embodiment are the same, because the distance from the center axis of the cylindrical member 203 to the contact region between the inclined surface portion 441*a* and the pressing members 461, where the force is generated, is longer than the distance from the center axis of the cylindrical member 203 to the second contact region, the force required to close the cover unit 300 according to the present exemplary embodiment is accordingly smaller than the force required in the comparison apparatus.

Next, the force required to position the pre-transfer guide member 47 is focused. As described above, the pre-transfer guide member 47 is attached to the side cover 150 with the coil spring 471 interposed therebetween. Pins 472 that extend in the width direction are provided to the both sides of the pre-transfer guide member 47 in the width direction. Then, fitting-grooves (not shown) into which the pins 472 are fitted are formed in the main body frame 200. Then, the pins 472 are fitted into the grooves, thereby positioning and fixing the pre-transfer guide member 47 to the main body frame 200. Here, the fitting-grooves are not formed so as to follow the trajectory of the rotation of the pins 472, but so as to be in parallel with the ground, the trajectory formed when the cover unit 300 rotates. For this reason, when the cover unit 300 is turned into the closed state, the force required for the pins 472 of the pre-transfer guide member 47 to be completely inserted into the fitting-grooves after the pins 472 come into contact with the fitting-grooves is large, and the required force becomes gradually small once the pins 472 are inserted into the fitting-grooves.

Figure 18A:
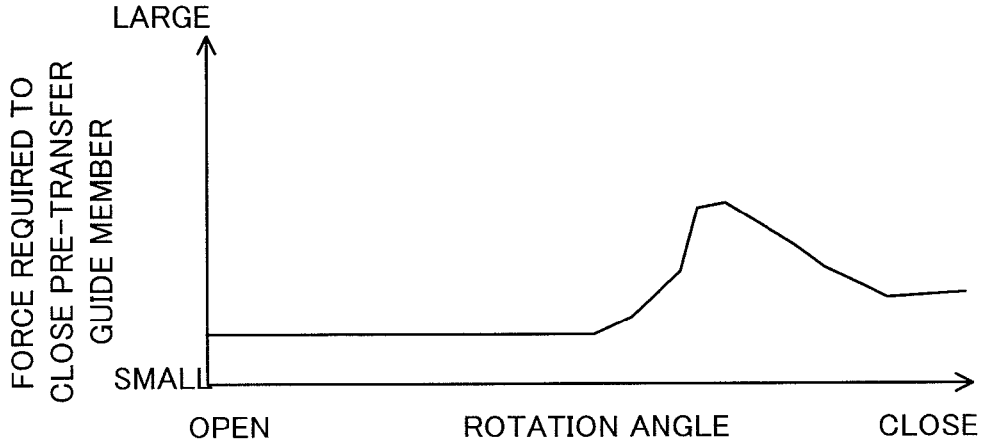
FIGS. 18A to 18C are diagrams for describing the force required to turn the cover unit 300 according to the present exemplary embodiment into the closed state.
Figure 18B:
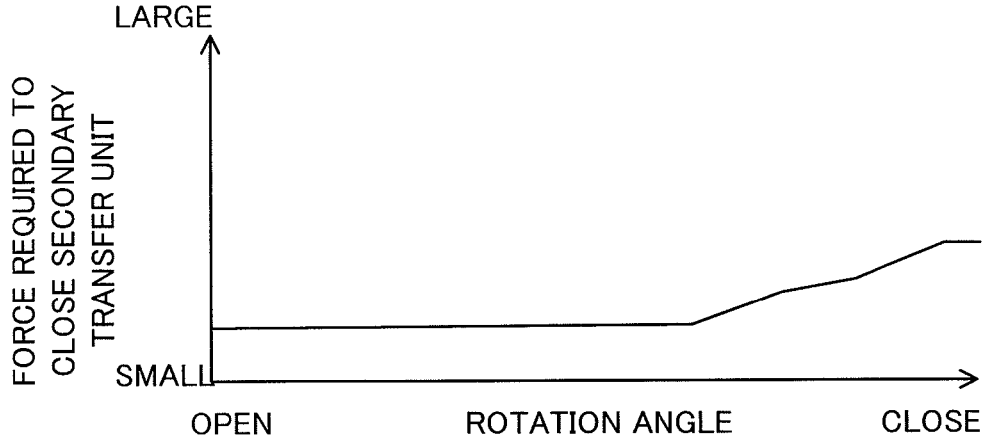
Figure 18C:
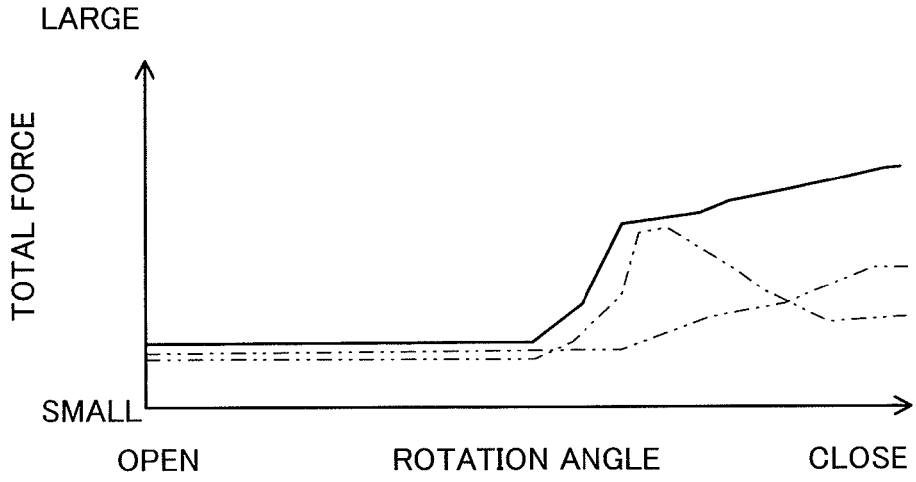

FIGS. 18A to 18C are diagrams for describing the force required to turn the cover unit 300 according to the present exemplary embodiment into the closed state. FIG. 18A is a diagram showing the force required to position and fix the pre-transfer guide member 47, with respect to the rotation angle formed when the cover unit 300 is rotated from the opened state to the closed state. FIG. 18B is a diagram showing the force required to position and fix the secondary transfer unit 40, with respect to the rotation angle of the cover unit 300, likewise. FIG. 18C is a diagram showing the force obtained by adding the operation load in FIG. 18A and the force in FIG. 18B.

As described above, in the operation load required to position and fix the pre-transfer guide member 47 shown in FIG. 18A, the required force reaches the peak by the time the pins 472 of the pre-transfer guide member 47 are completely inserted into the fitting-grooves after the pins 472 come into contact with the entrances of the fitting-grooves, and then, becomes gradually small once the pins 472 are inserted into the fitting-grooves.

As to the secondary transfer unit 40, as shown in FIG. 18B, after each of the positioning members 45 is brought into contact with the two sides of the corresponding V-shaped positioning groove 122, the cover unit 300 needs to be rotated against the force with which the inclined surface portion 441*a* of the center housing 441 presses the pressing members 461 of the force-applying units 46, as described above. At this time, the required force becomes gradually large in proportion to the rotation angle of the cover unit 300.

FIG. 18C shows the force as the entire operation load of the cover unit 300. Accordingly, the maximum operation load is small as compared with the apparatus where the timing at which the operation load required to position and fix the secondary transfer unit 40 reaches the peak is the same as the timing at which the operation load required to position and fix the pre-transfer guide member 47, for example.

Meanwhile, in order to make the force required to close the cover unit 300 smaller, it is also conceivable to provide a retraction mechanism to prevent the secondary transfer roller 41 from pressing the intermediate transfer unit 30 when the cover unit 300 is turned into the closed state from the opened state. However, when such a retract mechanism is to be provided, there arises a concern that the size of the cover unit 300 increases. In addition, another concern is that the number of components increases because of the retraction mechanism, hence causing an increase in the cost and weight.

Accordingly, the apparatus configuration according to the present exemplary embodiment allows making the apparatus small in size, light in weight, and low in price as compared with the apparatus including the retraction mechanism.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The exemplary embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier that carries a toner image;

a transfer unit that includes a transfer body that transfers the toner image carried by the image carrier onto a recording medium, and a positioning portion that positions the transfer body with respect to the image carrier by contact with a counterpart positioning portion provided to a main body of the image forming apparatus;

a guide portion that guides the recording medium to a position where the transfer body is to transfer the toner image carried by the image carrier onto the recording medium; and an opening and closing unit that supports both of the transfer unit and the guide portion and that is provided to be openable and closable by rotating with respect to the main body about a predetermined rotation center, the opening and closing unit forming different angles with respect to the main body between when a force required to position the transfer unit with respect to the main body reaches a maximum value, and when a force required to position the guide portion with respect to the main body reaches a maximum value.

2. The image forming apparatus according to claim 1, wherein the opening and closing unit further includes a force-applying unit that applies a rotation force to the transfer unit at a certain position when the transfer unit receives a contact force through the positioning portion during a process of turning the opening and closing unit from an opened state into a closed state, the rotation force being exerted in a direction opposite to a direction of rotation by a rotation force about a specific support point produced by the contact force, the certain position being more distant than a distance from the specific support point to a position where the contact force acts on the transfer unit.

3. The image forming apparatus according to claim 2, wherein the transfer unit includes a holding unit that holds the transfer body, and the force-applying unit makes contact with the holding unit, and applies, to the holding unit, the rotation force corresponding to a position of the holding unit with respect to the opening and closing unit.

4. The image forming apparatus according to claim 3, wherein the force-applying unit has an elastic member that is supported at the opening and closing unit and a pressing unit that presses the holding unit with a force corresponding to an elastic force of the elastic member, and the elastic member generates an elastic force that becomes larger as the position of the holding unit with respect to the opening and closing unit becomes closer.

5. The image forming apparatus according to claim 3, wherein the holding unit has a contact portion that comes into contact with a counterpart contact member which is provided to the main body and has a cylindrical outer surface, and the holding unit is rotatable with respect to the opening and closing unit about an axis center of the counterpart contact member in a state where the contact portion is in contact with the counterpart contact member.

6. The image forming apparatus according to claim 1, wherein the image carrier is an intermediate transfer unit including an intermediate transfer body that carries a toner image formed on a photoconductive body, and a plurality of rotation members that rotatably support the intermediate transfer body, and the transfer unit is a secondary transfer unit that presses at least one of the plurality of rotation members of the intermediate transfer unit, thereby transferring the toner image carried by the intermediate transfer body onto the recording medium.

7. An image forming apparatus comprising:

an image carrier that carries a toner image;

a transfer unit that includes a transfer body that transfers the toner image carried by the image carrier onto a recording medium, and a positioning portion that positions the transfer body with respect to the image carrier by contact with a counterpart positioning portion provided to a main body of the image forming apparatus;

a guide portion that guides the recording medium to a position where the transfer body is to transfer the toner image carried by the image carrier onto the recording medium;

an opening and closing unit that supports both of the transfer unit and the guide portion and that is provided to be openable and closable by rotating with respect to the main body about a predetermined rotation center; and a force-applying unit that applies a force to the transfer unit, the guide portion including a fitting portion that is fitted into a counterpart fitting portion provided to the main body, the guide portion being positioned with respect to the main body by causing the fitting portion to be fitted into the counterpart fitting portion before the opening and closing unit is brought into the closed state, wherein, during a process of turning the opening and closing unit from an opened state into the closed state, the positioning portion of the transfer unit and the counter positioning portion of the main body are brought into contact with each other after the fitting of the fitting portion provided to the guide portion into the counter fitting portion of the main body is started, thereby causing the opening and closing unit to be brought into the closed state.

8. The image forming apparatus according to claim 7, wherein the force-applying unit has an elastic member, and the transfer body of the transfer unit is pressed against the image carrier by an elastic force generated due to deformation of the elastic member.

9. The image forming apparatus according to claim 8, wherein an amount of deformation of the elastic member increases as a closing movement of the opening and closing unit, and reaches a maximum when the opening and closing unit arrives at the closed state.

10. An apparatus exterior unit that forms an exterior of a main body of an apparatus, the apparatus exterior unit supporting both of:

a transfer unit that includes: a transfer body that transfers a toner image carried by an image carrier onto a recording medium; and a positioning portion that positions the transfer body with respect to the image carrier by contact with a counterpart positioning portion provided to the main body of the apparatus; and a guide portion that guides the recording medium to a position where the transfer body is to transfer the toner image carried by the image carrier onto the recording medium, the apparatus exterior unit being provided to be openable and closable by rotating with respect to the main body of the apparatus about a rotation center, the apparatus exterior unit forming different angles with respect to the main body of the apparatus between when a force required to position the transfer unit with respect to the main body of the apparatus reaches a maximum value, and when a force required to position the guide portion with respect to the main body of the apparatus reaches a maximum value.

* * * * *